US009085437B2

(12) United States Patent
Shirakura et al.

(10) Patent No.: US 9,085,437 B2
(45) Date of Patent: Jul. 21, 2015

(54) SHEET FOLDING APPARATUS

(75) Inventors: Mizuho Shirakura, Fuefuki (JP); Hiroki Imazu, Kofu (JP); Shinichi Ito, Kofu (JP); Toshiaki Kagami, Minamikoma-gun (JP); Mitsunori Tomono, Suwa-gun (JP); Yuichi Kubota, Kofu (JP)

(73) Assignee: NISCA CORPORATION, Minamikoma-gun, Yamanashi-ken (JP)

( * ) Notice: Subject to any disclaimer, the term of this patent is extended or adjusted under 35 U.S.C. 154(b) by 1056 days.

(21) Appl. No.: 13/067,861

(22) Filed: Jun. 30, 2011

(65) Prior Publication Data

US 2012/0004086 A1 Jan. 5, 2012

(30) Foreign Application Priority Data

Jun. 30, 2010 (JP) ..... 2010-149507
Jul. 30, 2010 (JP) ..... 2010-171286
Oct. 5, 2010 (JP) ..... 2010-225596

(51) Int. Cl.
*B65H 45/18* (2006.01)
*B65H 45/12* (2006.01)

(52) U.S. Cl.
CPC ..... *B65H 45/12* (2012.01); *B65H 2801/27* (2013.01)

(58) Field of Classification Search
CPC ..... B65H 37/06; B65H 36/04; B65H 45/142; B65H 45/144; B65H 45/147; B65H 45/148
USPC ..... 493/424, 427, 434, 442, 454, 444, 419, 493/420; 270/32, 45
See application file for complete search history.

(56) References Cited

U.S. PATENT DOCUMENTS

| | | | | |
|---|---|---|---|---|
| 8,256,757 | B2 * | 9/2012 | Imazu et al. | 270/32 |
| 2011/0065563 | A1 * | 3/2011 | Taguchi | 493/442 |
| 2011/0101591 | A1 * | 5/2011 | Sano et al. | 270/20.1 |
| 2011/0101593 | A1 * | 5/2011 | Imazu et al. | 270/45 |
| 2011/0212817 | A1 * | 9/2011 | Imazu et al. | 493/442 |
| 2012/0275838 | A1 * | 11/2012 | Imazu et al. | 400/578 |
| 2013/0001848 | A1 * | 1/2013 | Hidaka et al. | 270/58.17 |
| 2014/0021679 | A1 * | 1/2014 | Kato | 271/109 |
| 2014/0062005 | A1 * | 3/2014 | Suzuki et al. | 271/220 |

FOREIGN PATENT DOCUMENTS

| | | |
|---|---|---|
| JP | 2001-002317 | 1/2001 |
| JP | 2005-008337 | 1/2005 |

(Continued)

*Primary Examiner* — Andrew M Tecco
*Assistant Examiner* — Tara M Ho
(74) *Attorney, Agent, or Firm* — Manabu Kanesaka

(57) ABSTRACT

To enable a sheet to be folded in an accurate position with a simplified folding mechanism in performing folding processing on the sheet with a pair of folding rollers, a second transport path is disposed in a direction for crossing a first transport path for guiding a sheet from a carry-in portion to a carrying-out portion, and in the cross portion are disposed a folding roller pair for performing folding processing on a sheet, and a folding deflecting member for inserting a fold of the sheet in the nip portion. Then, the folding deflecting member is comprised of a driven roller that comes into press-contact with a roller periphery of the folding roller pair, and a shift member for shifting the driven roller from a waiting position to an actuation position, and by the operation of shifting the driven roller from the waiting position outside the path to the actuation position, the sheet front end portion is fed to the nip portion from an upstream-side guide path formed in the second transport path. At this point, the shift velocity of the driven roller is made higher than the velocity of the sheet sent from the first transport path.

19 Claims, 21 Drawing Sheets

(56) References Cited

FOREIGN PATENT DOCUMENTS

| | | |
|---|---|---|
| JP | 2006-076776 | 3/2006 |
| JP | 2006-290618 | 10/2006 |
| JP | 2006-335500 | 12/2006 |
| JP | 2007-015785 | 1/2007 |
| JP | 2007-320665 | 12/2007 |
| JP | 2008-007297 | 1/2008 |
| JP | 2008-184324 | 8/2008 |
| JP | 2008-247531 | 10/2008 |

* cited by examiner

V1 > V2

LS2 > LS1

SHEET FOLDING APPARATUS

BACKGROUND OF THE INVENTION

1. Technical Field

The present invention relates to a sheet folding apparatus for folding a sheet with an image formed thereon, and more particularly, to improvements in the sheet folding mechanism for enabling a sheet to be folded in an accurate fold position with simplified structure.

2. Description of the Related Art

Generally, this type of sheet folding apparatus has been known as an apparatus for folding a sheet with an image formed thereon by an image formation apparatus such as a printing press, printer apparatus and copier in a predetermined fold position to perform finish processing. For example, Japanese Patent Application Publication No. 2008-247531 proposes an apparatus which is coupled to a sheet discharge outlet of an image formation apparatus, folds a sheet with an image formed for filing, and carries the sheet out to a subsequent binding processing apparatus.

The sheet folding apparatus for thus folding a sheet in half or one-third to carry out is configured as a post-processing apparatus of the image formation apparatus, or as a unit incorporated into the image formation apparatus or binding processing apparatus. Then, as a folding form, for example, for filing, various folding forms such as ½ folding, ⅓ Z-folding and ⅓ letter-folding are known corresponding to the intended use.

Then, the folding apparatus which is coupled to or incorporated into the image formation apparatus, binding apparatus (finisher apparatus, bookbinding apparatus) or the like is comprised of a folding processing mechanism and a transport mechanism for feeding and setting a sheet in the folding processing mechanism. For example, an apparatus is disclosed in Japanese Patent Application Publication No. 2008-247531 in which a collection guide for collating sheets that are fed sequentially in bunch form is provided with a roller pair that folds the bunch of sheets, and a folding plate disposed in a position opposed to the roller pair with a path therebetween inserts a fold of the bunch of sheets in a nip point of the roller pair.

Similarly, in Japanese Patent Application Publication No. 2007-320665 and Japanese Patent Application Publication No. 2008-007297, apparatuses are disclosed in which a pair of rollers and a folding plate (folding blade) are disposed in a path for feeding sheets, and the folding plate inserts a fold position of a sheet in a nip point of the pair of rollers to fold the sheet.

Then, with respect to transport members for feeding the sheet front end portion and rear end portion on the upstream side and downstream side of the folding rollers, the transport members are comprised of a front end stopper and a belt in Japanese Patent Application Publication No. 2007-320665. Meanwhile, the transport members are comprised of rollers in Japanese Patent Application Publication No. 2008-007297.

Then, control is performed to match the sheet velocity for inserting the sheet with the folding blade after the sheet fed to the fold position is once halted, the sheet velocity for folding the sheet with the pair of rollers, the sheet velocity for feeding the sheet with the transport member on the upstream side and the sheet velocity for feeding the sheet with the transport member on the downstream side with one another.

As described above, in the folding mechanism for inserting the fold position of the sheet in the nip between the rollers with the folding blade, unless the sheet velocity for inserting with the folding blade, the sheet velocity for folding with the pair of rollers, the sheet velocity for feeding with the transport member on the upstream side and the sheet velocity for feeding with the transport member on the downstream side are accurately matched with one another, there is a fear that the fold position is displaced, and the problem is known that each timing control becomes complicated.

Therefore, in Japanese Patent Application Publication No. 2005-008337, a folding mechanism is proposed in which a driven roller is disposed on the periphery of the roller positioned on the downstream side in the sheet transport direction between folding rollers in press-contact with each other to be movable between a waiting position and a press-contact position, and the driven roller is shifted from the waiting position to the press-contact position at timing at which the fold is formed.

According to this mechanism, the velocity for inserting with the driven roller, the velocity of folding rollers, and the sheet velocity for feeding with the transport member on the upstream side are the same (because of constituting with the same rollers), and the need for adjusting each velocity is eliminated.

Meanwhile, for example, in Japanese Patent Application Publication No. 2001-002317, Japanese Patent Application Publication No. 2008-184324, etc., it is disclosed that the blade shift velocity is set to be higher than the circumferential velocity of the folding rollers when a bunch of sheets is inserted in a pair of folding rollers in press-contact with each other with the folding blade and is folded.

Then, in Japanese Patent Application Publication No. 2006-290618 and Japanese Patent Application Publication No. 2007-015785, configurations are disclosed in which a deflecting member acts with opposite ends of the sheet nipped by a transport roller pair and a folding roller pair.

OBJECT OF THE INVENTION

As described above, the folding processing apparatus is already known in which a fold position of a sheet fed from a carry-in entrance is inserted in a pair of rollers coming into press-contact with each other with the folding blade, and the sheet is folded. Then, it is also known that displacement of the fold position significantly affects the finish quality. Accordingly, this type of the sheet folding apparatus is devised so that the sheet is reliably transported by the transport mechanism for transporting the sheet so as not to cause displacement.

The causes of such displacement of the sheet fold position are position displacement caused by fluctuations in transport of the transport mechanism for the sheet front end portion positioned on the upstream side of the fold, and the transport mechanism for the sheet rear end portion positioned on the downstream side of the fold, position displacement caused by fluctuations in the transport velocity in both transport mechanisms and the folding rollers, and position displacement occurring in inserting the sheet in the nip portion of the folding rollers.

Therefore, the inventor of the invention arrived at findings that a transport member (paper feed transport member) for feeding a sheet is provided on the downstream side (rear end portion) of the sheet, the driven roller is shifted to the periphery of the folding roller from the waiting position to the press-contact position at predetermined timing on the upstream side (front end portion) of the sheet, and that fluctuations in the transport velocity do not occur which would be caused by mutual interference among a plurality of transport mechanisms.

For example, a transport mechanism for feeding the sheet rear end portion is provided on the upstream side of a pair of folding rollers, and any particular transport mechanism is not provided on the sheet front end side. Then, the driven roller waiting outside the path is shifted to come into press-contact with the periphery of the roller, positioned on the downstream side, of the pair of folding rollers.

By this means, it is possible to configure the folding mechanism section to be simplified, while at the same time, reducing the causes of displacement of the folding position as described above.

In addition, in shifting the deflecting member provided with the driven roller from the waiting position to the actuation position, the sheet sometimes becomes wrinkled or becomes distorted in the fold position, and may be skewed.

Therefore, it is a first object of the invention to provide a sheet folding apparatus for enabling a sheet to be folded in an accurate position with a simplified folding mechanism in performing folding processing on the sheet with a pair of folding rollers.

Further, in the conventional folding deflecting member, rotation of the driving rotary shaft coupled to a driving motor is driven by a gear transmission mechanism, crank lever mechanism, or the like. In this case, when timing at which the front end (driven roller, blade member, etc.) of the folding deflecting member comes into contact with the periphery of the roller deviates from halting timing of the driving motor, there is a case that the position of the fold is displaced.

Therefore, conventionally, rotation of the driving motor is halted immediately before the front end of the folding deflecting member comes into contact with the periphery of the roller, and it is controlled to match the deflecting member with halting timing of the motor. However, since it is not possible to halt the driving motor instantaneously from the predetermined constant speed, for example, the motor is decelerated with an electric brake and is halted. The deceleration halt of the motor leads to fluctuations in the velocity of the folding deflecting member, and to displacement of the fold position similarly as in deviation in timing.

Then, it is a second object of the invention to provide a sheet folding apparatus for preventing fluctuations in the shift velocity at which the folding deflecting member shifts to the actuation position, and enabling a sheet to be folded in the accurate fold position.

BRIEF SUMMARY OF THE INVENTION

To attain the first object, in the invention, a second transport path is disposed in a direction for crossing a first transport path for guiding a sheet from a carry-in portion to a carrying-out portion, and in the cross portion are disposed a folding roller pair for performing folding processing on a sheet, and a folding deflecting member for inserting a fold of the sheet in the nip portion.

Then, the folding deflecting member is comprised of a driven roller coming into press-contact with a roller periphery of the folding roller pair, and a shift member for shifting the driven roller from a waiting position to an actuation position, and by the operation of shifting the driven roller from the waiting position outside the path to the actuation position, the sheet front end portion is fed to the nip portion from an upstream-side guide path formed in the second transport path. At this point, the shift velocity of the driven roller is made higher than the velocity of the sheet sent from the first transport path.

Further, in the first transport path is disposed a paper feed transport member for feeding the sheet toward the cross portion, and the upstream-side guide path of the second transport path is comprised of a curved path for providing the sheet with a transport load.

Accordingly, in a path configuration in which the second transport path is disposed in the direction for crossing the first transport path and the folding roller pair is disposed in the cross portion, the sheet front end portion is carried in the upstream-side guide path of the second transport path from the first transport path, and is fed to the nip portion with the driven roller shifting from the outside of the path to the actuation position to come into press-contact with the roller periphery of the folding roller pair, the sheet guided to the nip portion is not acted upon by a plurality of transport mechanisms, the driven roller operates in the position near the nip portion, and therefore, the displacement is reduced in the fold position of the sheet fed to the nip portion.

Concurrently therewith, by setting the shift velocity of the driven roller at a higher velocity than the velocity of the sheet fed from the first transport path, any distortion does not occur in the sheet when the driven roller guides the transported sheet to the nip portion of the folding roller pair.

Then, the driven roller is brought into contact with the contact point to contact the periphery of the folding roller without displacing the position of the contact point in which the transported sheet first comes into contact with the driven roller, and it is thereby possible to position the accurate fold position in the roller nip portion without wrinkles occurring in the sheet, or the like.

Further, by configuring the upstream-side guide path for guiding the sheet front end portion in a curved shape, it is possible to reduce fluctuations in the sheet front end portion, and wrinkles or damage does not occur to the sheet in the fold position.

Furthermore, the invention provides a folding roller pair in the transport path, a carry-in member for carrying a sheet in the folding roller pair, a sheet front end detecting member for detecting the sheet front end, and a folding deflecting member for guiding the sheet to the nip portion of the folding roller pair. Then, a calculating means is further provided for calculating a velocity and operation start timing at which the driven roller constituting the folding deflecting member is shifted to the actuation position for coming into contact with the folding roller periphery from the waiting position withdrawn from the transport path, based on a sheet transport velocity of the transport path. The calculating means sets the sheet deflecting velocity such that the driven roller is shifted from the waiting position to the actuation position at a higher velocity than the sheet transport velocity in a certain magnification relationship.

Thus, in the invention, the calculating means calculates the velocity (sheet deflecting velocity) of the driven roller for guiding the sheet to the folding processing section and the shift start timing with reference to the transport velocity of the sheet that is carried in the apparatus, and a front end detection signal such that the sheet arrives at a predetermined position in the transport path. Therefore, it is not necessary to provide the folding processing control section with complicated control data such as the sheet deflecting velocity and start timing, and it is thereby possible to install the apparatus in various image formation apparatuses.

Further, to attain the above-mentioned second object, in the invention, the folding deflecting member for guiding the sheet to the nip portion of the folding roller pair is comprised of the driven roller that comes into contact with the roller periphery, and an up-and-down member that holds the driven roller to shift from a waiting position to an actuation position, and the velocity at which the up-and-down member shifts from the waiting position to the actuation position is set at a higher velocity than the sheet velocity. Then, a driving means for shifting the up-and-down member is comprised of a driving rotary shaft, and a driving transfer member for transferring motion of the rotation, and the driving transfer member is configured to transfer driving of rotation of the driving rotary shaft so that the up-and-down member shifts from the waiting position to the actuation position at a predetermined velocity, while allowing rotation of the driving rotary shaft without transferring driving after the driven roller comes into contact with the roller periphery.

By thus configuring, the up-and-down member is allowed to guide the sheet to the roller nip portion at a constant velocity. Therefore, the sheet fed to the transport path is capable of being guided to the nip portion at a beforehand set optimal velocity, and it is possible to perform folding processing without the fold of the sheet being displaced.

Concurrently therewith, after the driven roller of the up-and-down member comes into contact with the roller periphery, the driving rotary shaft is allowed to rotate without shifting the up-and-down member. Therefore, when the driving motor coupled to the driving rotary shaft continues to rotate after the driven roller comes into contact with the roller periphery, the rotation does not affect the position of the driven roller. Accordingly, it is not necessary to match the halt timing of the driven roller with the timing at which the driven roller comes into contact with the roller periphery, and the need is thereby eliminated for controlling the halt timing and the inertia, by halting the driving motor after the driven roller comes into contact with the roller periphery.

Accordingly, the invention enables three motions to be set for respective optimal conditions without mutual motion timing interfering with one another, where the three motions are shifting the driven roller at a constant velocity in guiding the sheet to the nip portion of the folding roller pair in the process of shifting the driven roller from the waiting position outside the path to the actuation position, pressing the sheet against the roller periphery with a predetermined pressure by the driven roller, and halting the driving motor.

BRIEF DESCRIPTION OF THE SEVERAL VIEWS OF THE DRAWINGS

FIG. 6 contains explanatory views of operating states of the apparatus of FIG. 2, where

FIG. 7 contains explanatory views of operating states of the apparatus of FIG. 2, where

FIG. 8 contains explanatory views of operating states of the apparatus of FIG. 2, where

FIG. 9 contains explanatory views of operating states of the apparatus of FIG. 2, where

FIG. 10 contains graphs showing the velocity relationship of the deflecting member, where

FIG. 11 contains explanatory views of sheet folding forms in the sheet folding apparatus of the invention, where

FIG. 17 contains explanatory views of Embodiment 2 of the deflecting member, where

FIG. 18 contains explanatory views of operating states of the deflecting member of FIG. 17, where

DETAILED DESCRIPTION OF THE INVENTION

Figure 1:
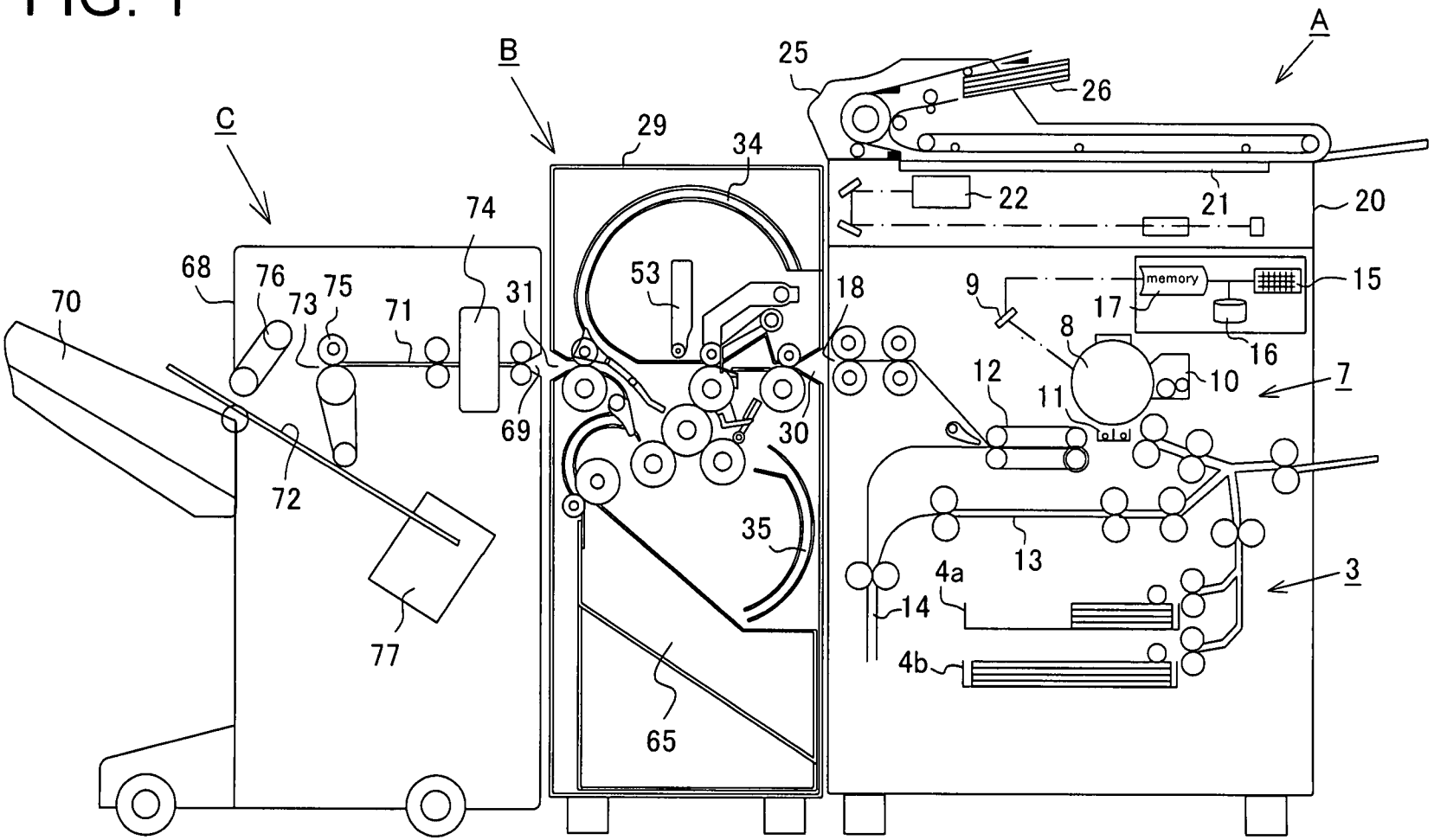
FIG. 1 is an explanatory view of an entire configuration of an image formation system provided with a sheet folding apparatus according to the invention.

The invention will specifically be described below based on Embodiments shown in the figures. FIG. 1 shows an image formation system provided with a sheet folding apparatus according to the invention. This system is comprised of an image formation apparatus A and a post-processing apparatus C, and the post-processing apparatus C is installed with a sheet folding apparatus B as a unit.

The image formation apparatus A is configured as a printer, copier, printing press or the like for sequentially forming images on sheets. The apparatus as shown in the figure is comprised of an image formation section 7, original document reading section 20 and feeder section (original document feeding apparatus) 25 as a complex copying machine having the copier function and the printer function. Further, the post-processing apparatus C is coupled to a main-body sheet discharge outlet 18 of the image formation apparatus A, and is configured to perform post-processing such as folding processing, punching processing, sealing processing and binding processing on a sheet with an image formed. Then, the post-processing apparatus C is integrally provided with the sheet folding apparatus B for performing folding processing on a sheet with an image formed. The sheet folding apparatus B, image formation apparatus A and post-processing apparatus C will be described below in this order.

[Sheet Folding Apparatus]

The sheet folding apparatus B according to the invention is incorporated into the image formation apparatus A or the post-processing apparatus C, or is configured as an apparatus (stand-alone configuration) independent of the apparatuses. The apparatus as shown in the figure is disposed between the image formation apparatus A and the post-processing apparatus C as an optional unit.

Figure 2:
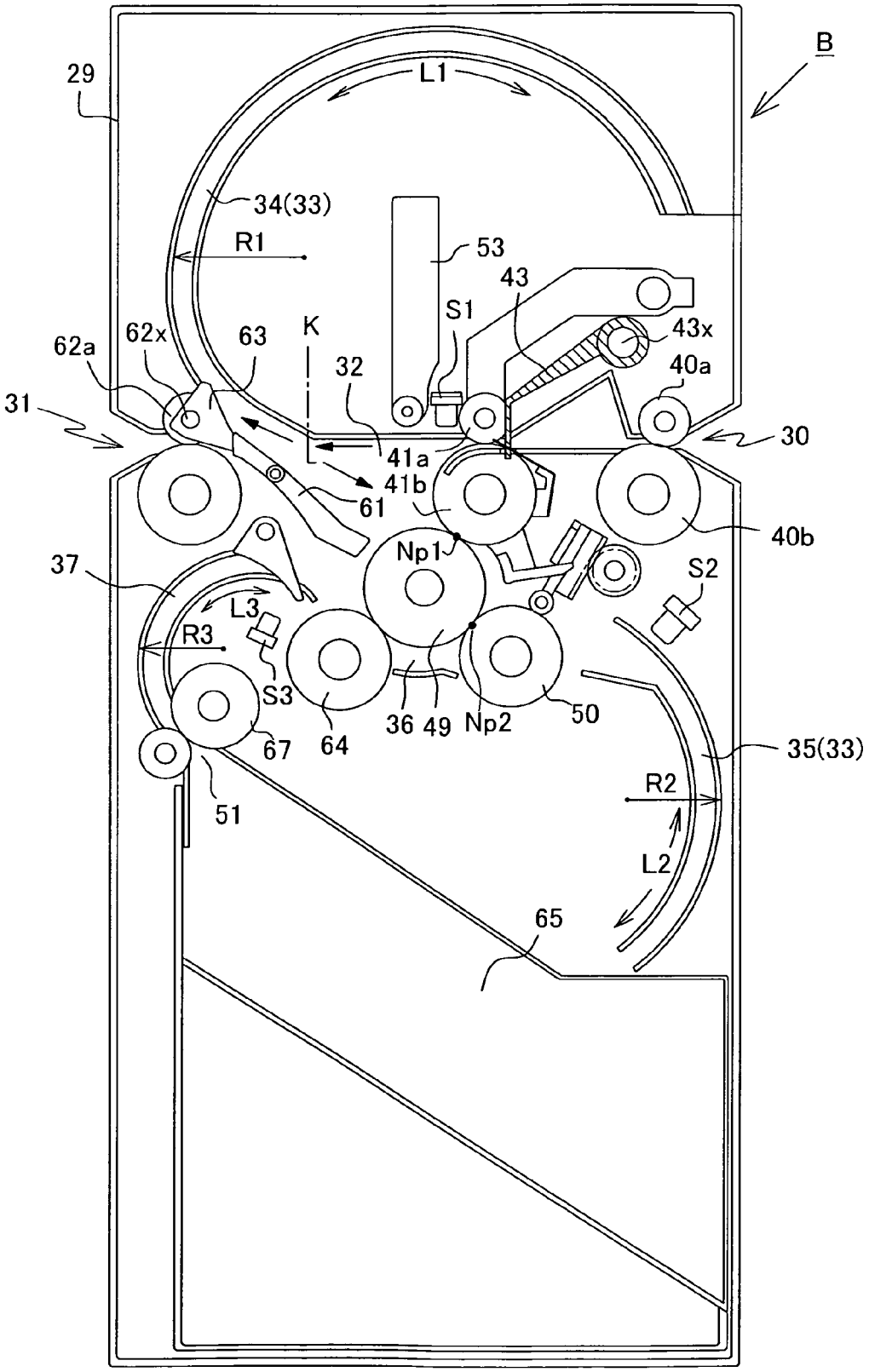
FIG. 2 is an explanatory view of an entire configuration of the sheet folding apparatus in the system of FIG. 1.

In the sheet folding apparatus B, as shown in FIG. 2 illustrating the entire configuration, an apparatus housing 29 is provided with a carry-in entrance 30 and a carrying-out exit 31, the carry-in entrance 30 is arranged in a position continued to the main-body sheet discharge outlet 18 of the image formation apparatus A on the upstream side, and the carrying-out exit 31 is arranged in a position continued to a sheet receiving opening 69 of the post-processing apparatus C on the downstream side.

In addition, in the invention, there are cases that the sheet folding apparatus B is not provided with an independent apparatus housing 29, and for example, is incorporated into a casing of the post-processing apparatus C, and the cases do not require the carry-in entrance 30 and carrying-out exit 31.

Accordingly, in the following description, the carry-in entrance 30 is synonymous with a carry-in portion, the carrying-out exit 31 is synonymous with a carrying-out portion, and for convenience in description, the description is given while assuming that the carry-in portion is the carry-in entrance 30 and that the carrying-out portion is the carrying-out exit 31.

As shown in FIG. 2, the carry-in entrance 30 and carrying-out exit 31 are disposed opposite each other across the apparatus housing 29. The carry-in entrance 30 and carrying-out exit 31 shown in the figure are disposed in opposite positions in the substantially horizontal direction. Then, in between the carry-in entrance 30 and the carrying-out exit 31 are disposed a first transport path 32 for carrying out a sheet from the carry-in entrance 30 to the carrying-out exit 31 without performing folding processing, and a second transport path 33 for performing the folding processing on a sheet from the carry-in entrance 30 to carry out to the carrying-out exit 31. A "sheet transport mechanism" for carrying a sheet in the predetermined direction (horizontal direction) is disposed in the first transport path 32, and a "folding processing mechanism" for performing the folding processing on a sheet is disposed in the second transport path 33.

[Path Configuration]

As shown in FIG. 2, in the apparatus housing 29, the first transport path 32 is disposed between the carry-in entrance 30 and the carrying-out exit 31. This path may be a linear path disposed in the horizontal direction as shown in the figure, may be configured as a curved path, or may be disposed in the vertical direction, and it is possible to adopt any configuration. As described above, the first transport path 32 guides a sheet from the carry-in entrance 30 to the carrying-out exit 31 without performing the folding processing.

Further, the second transport path 33 is configured as a path for performing the folding processing on a sheet from the carry-in entrance 30. Therefore, the second transport path 33 branches off from the first transport path 32, and is configured to guide a sheet from the carry-in entrance 30 to sheet folding positions Np1 and Np2. Concurrently therewith, as shown in FIG. 2, the second transport path 33 is disposed in a direction in which the path 33 crosses the first transport path 32, and the first folding position Np1 and the second folding position Np2 are set in this path.

Then, the second transport path 33 is comprised of a first switchback path 34 for guiding the sheet front end for first folding to the first folding position Np1, and a second switchback path (downstream-side guide path; the same in the following description) 35 for guiding the folded sheet front end to the second folding position Np2 to perform second folding on the folding-processed sheet.

Thus, the second transport path 33 is disposed in the direction to cross the first transport path 32, where the first switchback path 34 is disposed in the area above the first transport path 32, the second switchback path 35 for carrying a sheet from the cross portion K to the downstream side (the direction of the second folding position Np2) is disposed in the area below the first transport path 32, and the paths 34 and 35 are thus arranged to be opposed.

Then, each of the first switchback path 34 and second switchback path 35 is comprised of a curved path and formed substantially in the shape of an S-curve as shown in FIG. 2. In the second transport path 33, folding processing means (folding roller mechanism) 48 described later is disposed in the first folding position Np1 and second folding position Np2, and the second transport path 33 is connected to a third transport path 36 for carrying out the folded sheet from the second folding position Np2 toward the carrying-out exit 31.

In addition, the first transport path 32 and the second transport path 33 are disposed to cross each other, and the first switchback path 34 for guiding the sheet to the first folding position Np1 may be disposed below the first transport path 32, while the second switchback path 35 for guiding the folding-processed sheet to the downstream side may be disposed above the first transport path 32.

Further, in the Embodiment of FIG. 2, the first transport path 32 is disposed in the horizontal direction, and when the first transport path 32 is disposed in the vertical direction in the apparatus housing 29, it is possible to arrange the first switchback path 34 and second switchback path 35 to the left and right areas of the first transport path 32 to be opposite each other.

Furthermore, in the Embodiment as shown in FIG. 2, in relation to the second switchback path 35 guiding the folded sheet to the second folding position Np2 to perform second folding on the sheet, the path 35 is configured to reverse the feeding direction of the sheet, but when second folding is not performed on the sheet, the path 35 can be a path to extend straight.

The second transport path 33 is connected to the third transport path 36 for guiding the folding-processed sheet to the carrying-out exit 31. The third transport path 36 shown in the figure is provided in between the second folding position Np2 for performing second folding on the sheet and the carrying-out exit 31. In the third transport path 36 is disposed a sheet discharge path 37 for guiding the folded sheet to a storage stacker 65 from a sheet discharge outlet 51 different from the carrying-out exit 31.

The first switchback path 34 configured as described above is formed of a path curved in the shape of an arc having the curvature R1 as shown in FIG. 2, and the second switchback path 35 is formed of a path curved in the shape of an arc having the curvature R2. Further, the sheet discharge path 37 continued to the third transport path 36 is also formed of a path curved in the shape of an arc having the curvature R3.

Then, a path length (L1) of the first switchback path 34 for guiding a sheet from the first transport path 32 to the first folding position (first nip portion) Np1 and a path length (L2) of the second switchback path 35 for guiding the folded sheet subjected to first folding to the second folding position (second nip portion) Np2 are configured so that path length L1>path length L2.

A path length L3 of the sheet discharge path 37 for guiding the sheet further subjected to the folding processing to the storage stacker 65 from the second folding position Np2 is configured so that L3<L2<L1. This is because when the first folding position (first nip portion) Np1 is disposed near the first transport path 32, the path lengths are L3<L2<L1 as a result, and the path configuration is thereby made compact.

Thus, the first switchback path 34 with the longest path length is disposed above the first transport path 32, the second switchback path 35 with the short path length is disposed below the first transport path 32, the sheet discharge path 37 is similarly disposed below the first transport path 32, and the storage stacker 65 is disposed further below.

Accordingly, the first switchback path 34 with the long path length is disposed in the upper area of the first transport path 32, the second switchback path 35 and the sheet discharge path 37 with the short path lengths are disposed in the lower area of the first transport path 32 opposite the upper area, and further, the storage stacker 65 is disposed below the second switchback path 35 and the sheet discharge path 37. By such a layout configuration, it is possible to make the inside space of the apparatus housing 29 compact.

[Path Switching Means]

A path switching means 63 is disposed in the cross portion K of the above-mentioned first transport path 32 and second transport path 33. According to FIG. 3, the path switching means 63 will be described. The means 63 is a guide member which is axially supported by a spindle 62*x* of a carrying-out roller 62*a* to be swingable, and switches the path of the sheet fed from the first transport path 32 between guiding to the first switchback path 34 (the solid line in FIG. 3) and guiding to the carrying-out exit 31 (the dashed line in FIG. 3).

Further, a sheet guide 61 is provided in the cross portion K of the first transport path 32 and second path transport 33. The sheet guide 61 is disposed in between a first roller (paper feed transport roller pair) 41*b* and the carrying-out roller pair 62*a*, 62*b* in the first transport path 32, and is axially supported to be swingable between the attitude (the solid line in FIG. 3) for guiding the sheet fed from the first transport path 32 to the first switchback path 34 and the attitude for guiding the sheet to the carrying-out exit 31 (the dashed line in FIG. 3).

[Configuration of Folding Rollers]

Figure 3:
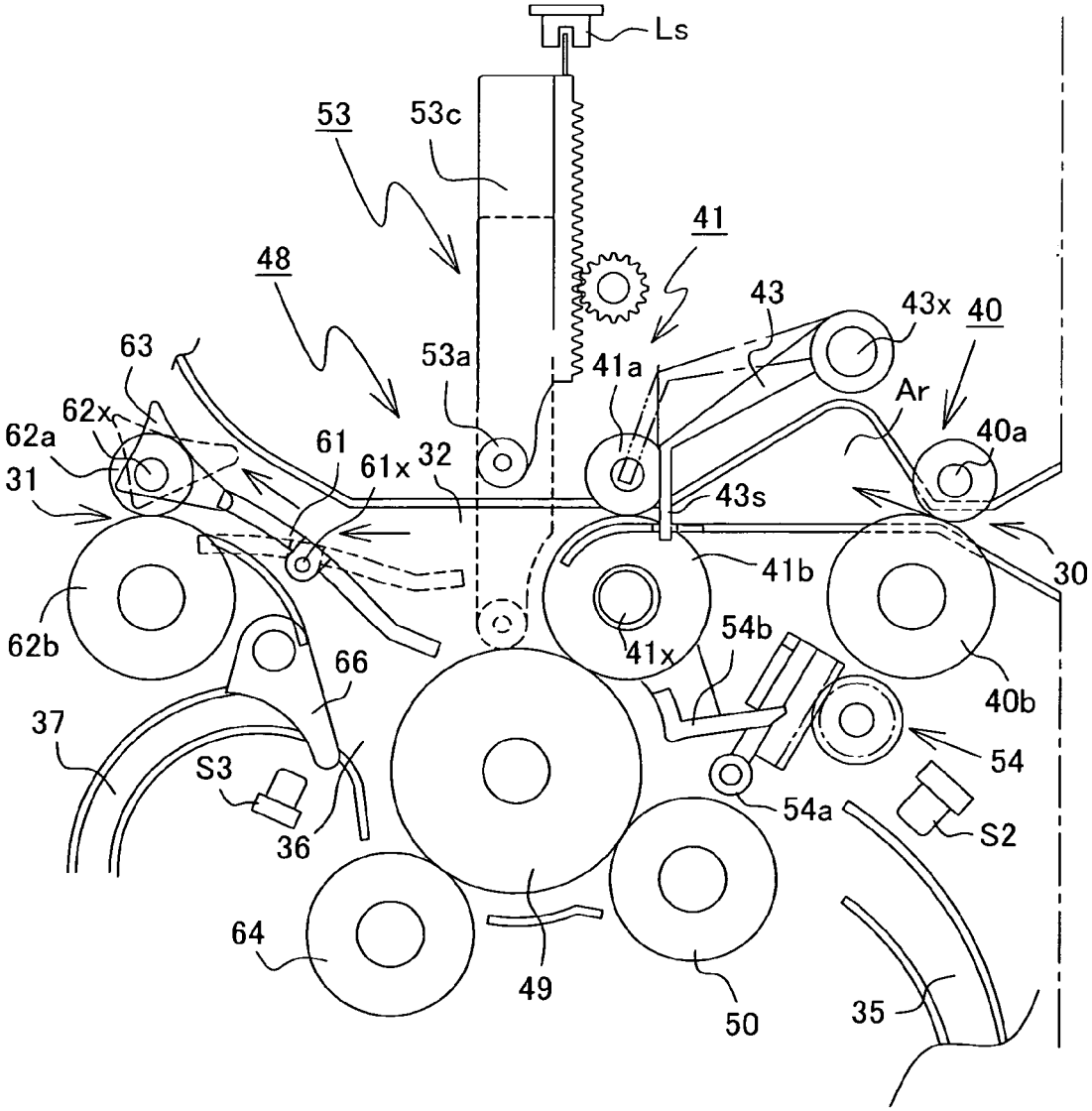
FIG. 3 is an enlarged explanatory view of principal part of the sheet folding apparatus in the system of FIG. 2.

As shown in FIGS. 2 and 3, in the second transport path 33 is disposed a folding roller mechanism comprised of folding roller pairs. The first roller 41*b*, second roller 49 and third roller 50 are disposed in the cross portion K of the first transport path 32 and the second transport path 33 to come into press-contact with one another (see FIG. 3).

The first nip portion (first folding position) Np1 for first folding the sheet is formed in a press-contact point between the first roller 41*b* and second roller 49, and the second nip portion (second folding position) Np2 for second folding the sheet is formed in a press-contact point between the second roller 49 and the third roller 50.

In addition, the diameter of each of the first, second and third rollers is set at the same outside diameter in the apparatus as shown in the figure. The dimension may be set as appropriate, for example, so that the second roller diameter is the maximum.

Further, as shown in FIG. 3, the first roller 41*b* is disposed in the position such that part of the periphery faces the first transport path 32, and a pinch roller (floating roller) 41*a* is brought into press-contact with the periphery of the roller 41*b*. The first roller 41*b* and the pinch roller 41*a* in press-contact with each other constitute the paper feed transport member (hereinafter, referred to as "paper feed transport roller pair 41") of the first transport path 32, and the sheet from the carry-in entrance 30 is thereby transported to the downstream side.

[Configuration of the Folding Deflecting Member]

In the folding rollers comprised of three rollers (41*b*, 49, 50) as described above, the first folding deflecting member 53 is disposed in the first nip portion Np1, and the second folding deflecting member 54 is disposed in the second nip portion Np2 (see FIG. 3).

In the apparatus as shown in the figure, the first folding deflecting member 53 and the second folding deflecting member 54 are provided with the function of "inserting a fold position of a sheet in the roller nip portion", and the function of "feeding the sheet front end portion to the nip portion".

Therefore, the first and second folding deflecting members 53, 54 are provided with driven rollers 53*a*, 54*a*, and configured to shift from a waiting position outside the path to an actuation position for coming into press-contact with the periphery of the folding roller. The operation of the driven roller shifting from the waiting position to the actuation position acts to feed the sheet end portion to the roller nip portion.

Figure 4:
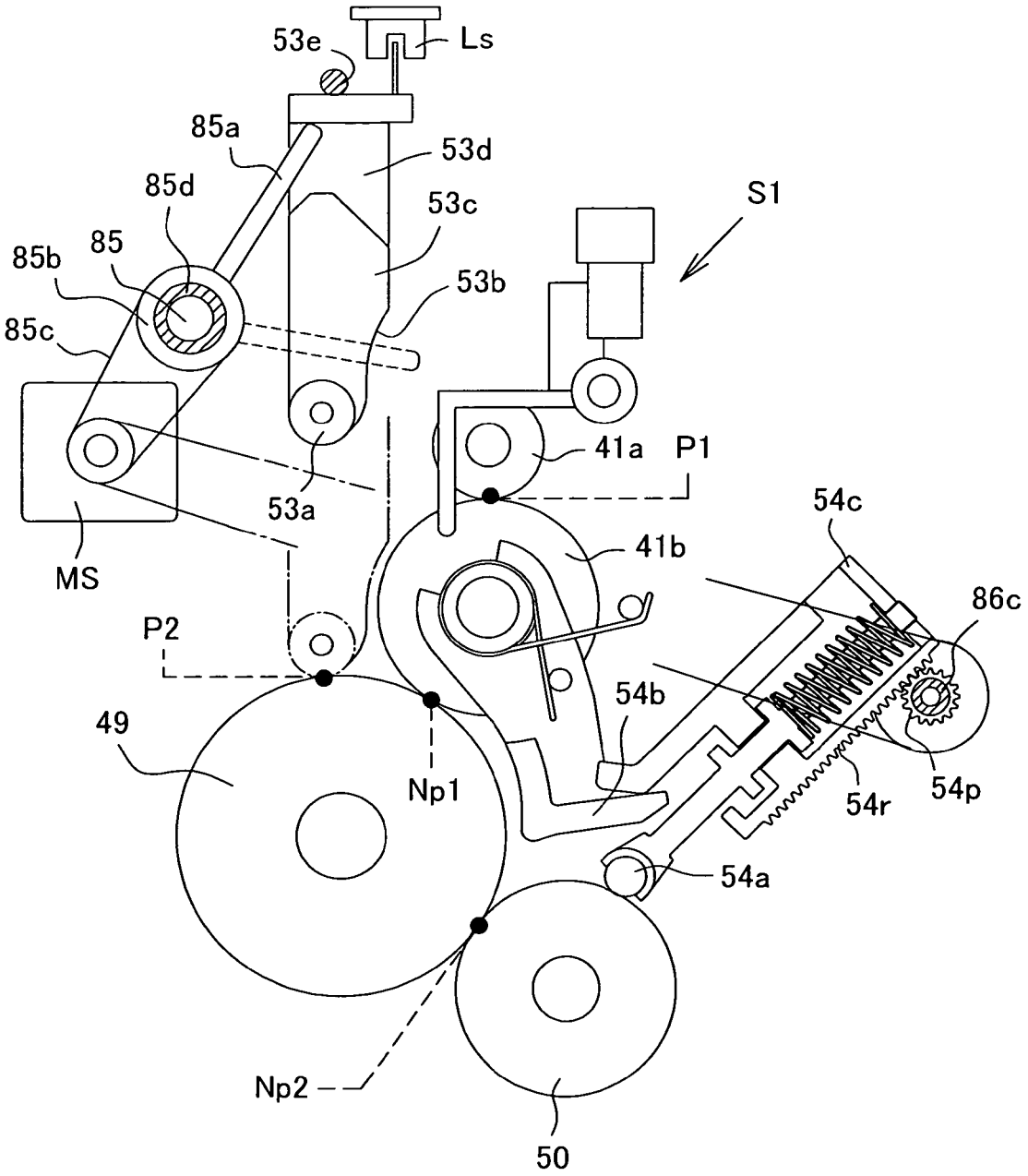
FIG. 4 is an explanatory view of a driving mechanism of a first folding deflecting member and a second folding deflecting member in the apparatus of FIG. 2.

FIG. 4 shows the configuration of the first folding deflecting member 53. The first folding deflecting member 53 is comprised of the driven roller 53*a*, curved guide 53*b* and up-and-down member 53*c*. As shown in the figure, the driven roller 53*a* is supported by the up-and-down member 53*c* to be rotatable, and the curved guide 53*b* is integrally attached to the member 53*c*.

Then, the driven roller 53*a* is disposed in a position to come into contact with the periphery of the second roller 49 positioned on the downstream side in the sheet shift direction of the first transport path 32, and the curved guide 53*b* is disposed in a position along the periphery of the first roller 41*b* positioned on the upstream side.

The up-and-down member 53*c* is supported by a guide rail (not shown) provided in the apparatus frame, and is able to reciprocate in a predetermined stroke. The up-and-down member 53*c* is provided with a cam groove 53*d*, and in the cam groove 53*d* is engaged an actuation lever 85*a* axially supported at its spindle 85*x* by the apparatus frame.

Then, the actuation lever 85*a* is coupled to the spindle 85*x* via a spring clutch (torque limiter) 85*d*. A pulley 85*b* is provided in the spindle 85*x*, and rotation of a shift motor MS is conveyed to the pulley 85*b* via a transmission belt 85*c*.

Accordingly, when the shift motor MS rotates in the forward direction (clockwise direction in FIG. 4), the actuation lever 85*a* shifts from the solid-line state to the dashed-line state. Then, after the driven roller 53*a* comes into contact with the periphery of the second roller 49, the spring clutch 85*d* idles.

When the shift motor MS rotates in the reverse direction, the actuation lever 85*a* rises from the dashed-line state to the solid-line state. After the up-and-down member 53*c* strikes the stopper 53*e*, the spring clutch 85*d* idles, and the lever 85*a* is locked in the position.

In addition, a limit sensor Ls is disposed in the position, and with a state signal such that the up-and-down member 53*c* shifts to a predetermined stopper position, the rotation of the shift motor MS is halted.

Meanwhile, as in the first folding deflecting member 53, in the second folding deflecting member 54, an up-and-down member 54*c* is supported by the apparatus frame to move up and down in a predetermined stoke. The up-and-down member 54*c* is provided with the driven roller 54*a* and a curved guide 54*b*.

The up-and-down member 53*c* is provided with a rack 54*r*, and the rack 54*r* meshes with a pinion 54*p*. The pinion 54*p* is coupled to the shift motor MS via a spring clutch 86*c*. The spring clutch 86*c* is set to convey the rotation of the shift motor MS within predetermined torque, while idling at predetermined torque or more.

[Driving Mechanism of the Folding Deflecting Member]

Described next is a driving mechanism for the first folding deflecting member 53 and second deflecting member 54. As shown in FIG. 4, in the first folding deflecting member 53, the driven roller 53*a* and the curved guide 53*b* are supported by the up-and-down member 53*c* moving up and down in a predetermined stroke. The up-and-down member 53*c* is provided with the actuation lever 85*a* swingable on the spindle shaft 85*x* to engage in the member 53*c*. In other words, in the up-and-down member 53*c* supported by the apparatus frame in a guide rail (not shown) to be able to move up and down, the cam groove 53*d* is provided, and is disposed so that the front end of the actuation lever 85*a* engages in the cam groove 53*d*.

Then, the actuation lever 85*a* is coupled to the spindle 85*x* via the spring clutch 85*d*. Concurrently therewith, the spindle 85*x* is provided with the pulley 85*b*, and rotation of the shift motor MS is conveyed to the pulley 85*b* via the transmission belt 85*c*. Then, the spring clutch 85*d* is set to convey the rotation of the shift motor MS from the spindle 85*x* to the actuation lever 85*a*. Concurrently therewith, when the load of predetermined torque or more is imposed, the spring clutch 85*d* idles with respect to the spindle 85*x*, and is configured not to convey the rotation of the shift motor MS to the actuation lever 85*a*.

In addition, in the first folding deflecting member 53 and the second folding deflecting member 54, the up-and-down member 53*c* shifts in position from the waiting position to the actuation position by the forward-direction rotation of the shift motor MS, and by the rotation in this direction, the up-and-down member 54*c* of the second folding deflecting member 54 shifts in position from the actuation position to the waiting position.

Alternately, in the backward-direction rotation of the shift motor MS, the up-and-down member 54*c* of the second folding deflecting member 54 shifts in position from the waiting position to the actuation position, and by the rotation in this direction, the up-and-down member 53*c* of the first folding deflecting member 53 shifts in position from the actuation position to the waiting position.

Thus, the first folding deflecting member 53 and second folding deflecting member 54 are configured to shift to positions between the actuation position and the waiting position in a relatively opposite manner by forward and backward rotation of the shift motor MS.

[Sheet Transport Mechanism]

The sheet transport mechanism of the first transport path 32 and the second transport path 33 as described above will be described according to FIGS. 2 and 3. In the first transport path 32, the carry-in roller pair 40 is disposed in the carry-in exit (carry-in portion) 30, and carries in the sheet that is fed from the outside of the apparatus. The paper feed transport roller pair 41 is disposed in between the cross portion K of the first transport path 32 and second transport path 33 and the carry-in roller pair 40. The paper feed transport roller pair 41 shown in the figure is comprised of the first roller 41*b* and the pinch roller 41*a* in press-contact with the roller 41*b*.

In addition, in the first transport path 32, a register area Ar is provided on the downstream side of the carry-in roller pair 40, and a gate stopper 43 is disposed in the register area Ar. The gate stopper 43 is configured to be swingable on the spindle 43*x*, and temporarily locks the sheet front end by a lock surface 43*s* at its front end portion to perform register correction. Therefore, the gate stopper 43 is coupled to an actuation solenoid not shown.

In the second transport path 33 are disposed the first roller 41*b*, second roller 49 and third roller 50 in press-contact with one another, and the sheet discharge roller 67 is disposed in the sheet discharge path 37. Meanwhile, the sheet transport mechanism is not disposed in the first switchback path 34 and the second switchback path 35.

[Sheet Front End Detecting Sensor]

As shown in FIG. 2, in the first transport path 32, a first sensor S1 to detect an end edge of a sheet is disposed, and detects the end edge (front end and rear end) of the sheet to carry in the first switchback path 34. Further, in the second switchback path 35 is disposed a second sensor S2 that detects the end edge of the sheet to carry in.

The first sensor S1 and second sensor S2 detect the end edge of the sheet to calculate a fold position of the sheet, and the action will be described later together with folding forms.

[Sheet Transport Control]

Then, in the invention, it is a feature that control is performed as described below in feeding a sheet from the carry-in entrance 30 into the first nip portion Np1.

[Configuration as the Premise]

In the cross portion K are disposed the first nip portion Np1 of the first roller 41*b* and second roller 49, and the first folding deflecting member 53. Further, on the upstream side of the cross portion K, the paper feed transport roller pair 41 is disposed in the first transport path 32, and the upstream-side guide path (first switchback path) 34 positioned on the downstream side of the cross portion K is not provided with any transport member for constraining the sheet. Therefore, a plurality of transport mechanisms does not mutually interfere, and any fluctuation in the transport velocity does not occur.

Further, the first folding deflecting member 53 is provided with the driven roller 53*a* that comes into press-contact with the roller periphery of the second roller 49 positioned on the downstream side in the direction of travel of the sheet shifting in the first transport path 32, and the driven roller reciprocates between the waiting position Wp outside the path and the actuation position Ap in press-contact with the roller periphery.

In such a configuration, the feature of the invention will be described according to FIG. 5. As shown in the figure, the velocity V1 for shifting the driven roller 53*a* of the first folding deflecting member 53 from the waiting position Wp to the actuation position Ap is set at a velocity higher than the velocity V2 of the sheet shifting in the first transport path 32 (for example, the velocity is set at V1=1.7×V2).

Therefore, the circumferential velocity V2 of the paper feed transport roller 41 and the descending velocity V1 of the up-and-down member 53*c* are set at V1□V2. This velocity control is made by controlling the rotation speeds of the transport motor MF of the first roller 41*b* and the shift motor MS of the first folding deflecting member 53.

Figure 10A:
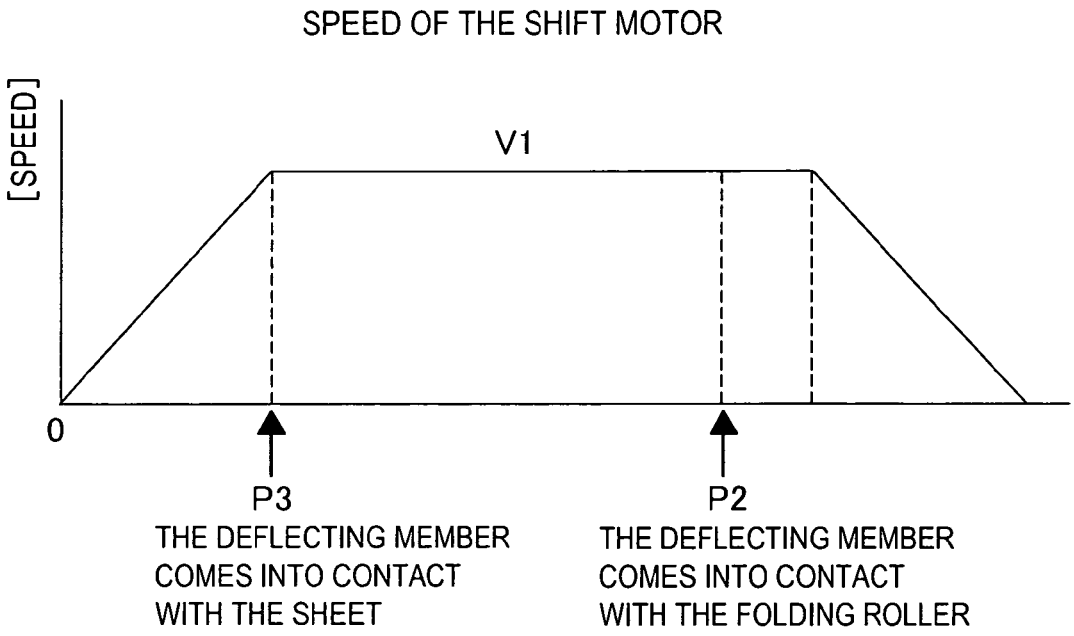
FIG. 10A shows the speed of a shift motor.
Figure 10B:
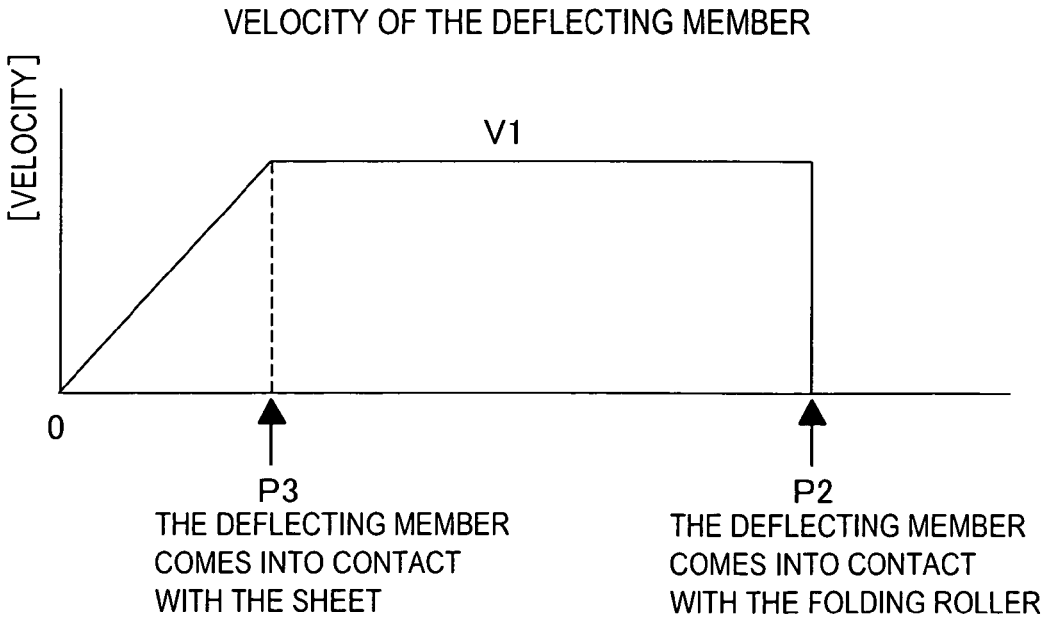
FIG. 10B shows the velocity of the deflecting member.

FIG. 10 shows the rotation speed control of the shift motor MS. FIG. 10A shows the case where the up-and-down member 53*c* is accelerated to the velocity Vi from the top dead center (the solid line in FIG. 5) to a point P3 in which the driven roller 53*a* comes into contact with the sheet fed in the first transport path 32, and after the driven roller 53*a* comes into contact with the second folding roller 49, is decelerated after a lapse of predetermined time and halted. Further, FIG.

10B shows the case where the up-and-down member 53*c* is halted at timing at which the driven roller 53*a* comes into contact with the second folding roller 49.

Figure 5:
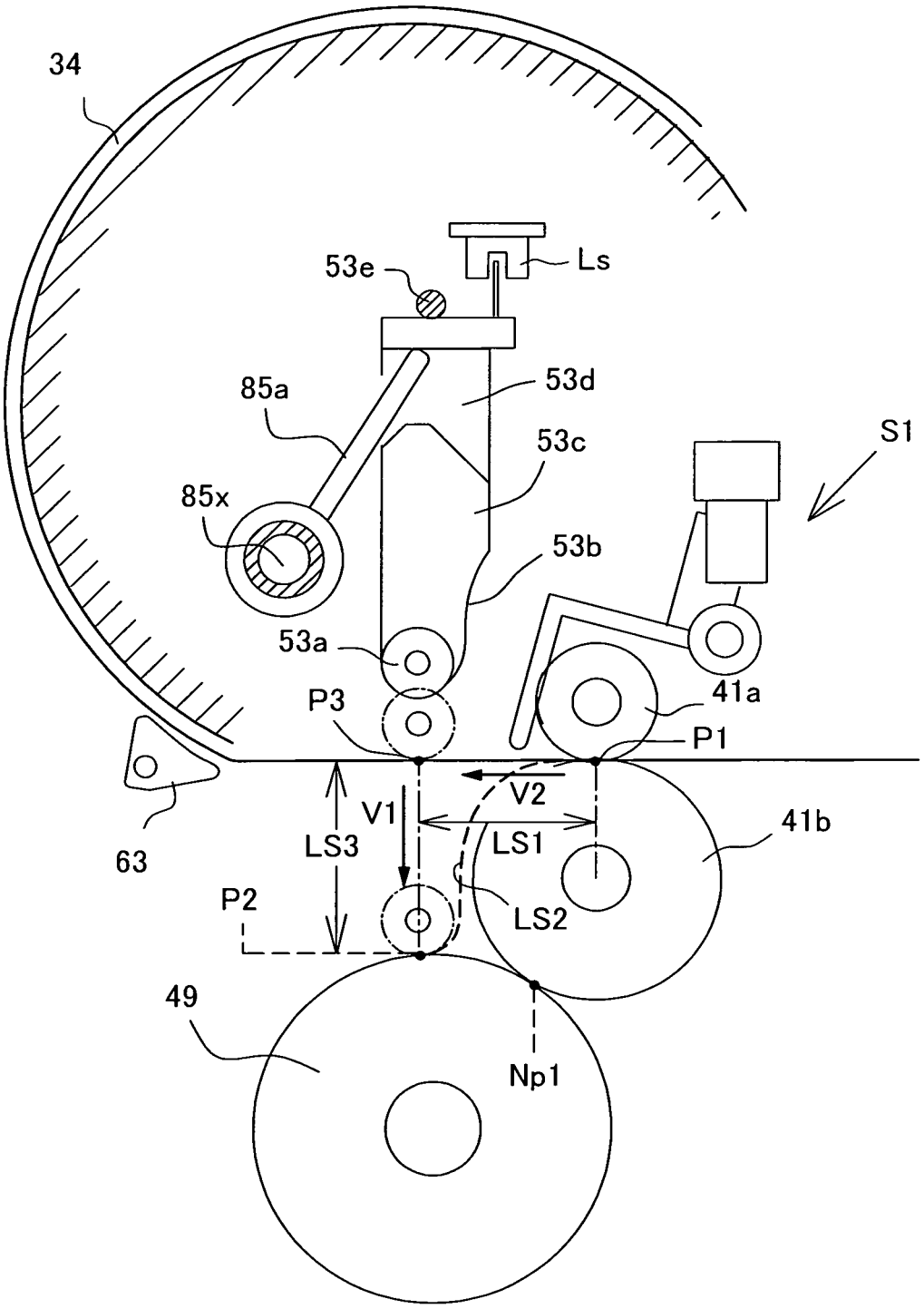
FIG. 5 is a conceptual diagram illustrating the relationship between the shift velocity of the deflecting member and the sheet transport velocity.

Then, the nip pressure of the pinch roller 41*a* and the first folding roller 41*b* in the press-contact point P1 as shown in FIG. 5 is set at 4 kg. This is the optimal nip pressure for providing the carried-in sheet with skew correction. Further, the nip pressure of the driven roller 53*a* and the second folding roller in the press-contact point P2 is set at 1.5 kg. In other words, the nip pressure of the sheet in the press-contact point P1 is set at a higher pressure than the nip pressure of the sheet in the press-contact portion P2 (about three times in the apparatus as shown in the figure), and the fold position of the sheet is thereby controlled to the press-contact point P1.

Thus, the sheet is fed by the paper feed transport roller pair 41, and is transported to the nip only by the paper feed transport roller pair 41, the driven roller 53*a* moves downward in the direction orthogonal to the transport direction in the cross portion K, and the roller shift velocity V1 is set at a higher velocity than the sheet velocity V2.

Therefore, the shift displacement amount of the sheet front end portion in the upstream-side guide path (first switchback path) 34 is larger than the shift displacement amount of the sheet rear end portion fed by the paper feed transport roller pair 41.

In other words, as the driven roller 53*a* shifts, the front end portion side in the sheet shifts with a larger displacement amount than the rear end portion side. As a result, the sheet is guided to the first nip Np1 with reference to the press-contact point P1 of the paper feed transport roller pair 41 in the rear end portion.

Concurrently therewith, the sheet front end portion is acted upon by the frictional load (transport load) of the upstream-side guide path (first switchback path) 34, and therefore, the sheet is guided to the first nip Np1 by the driven roller 53*a* without the sheet front end portion side wandering.

Further, the upstream-side guide path (first switchback path) 34 is configured in the shape of a curved path. By this means, with respect to the sheet front end portion that is fed out to the path by the paper feed transport roller pair 41, the attitude of the sheet front end portion does not wander, and with respect to the frictional load (transport load) of the guide member constituting the curved path when the sheet is fed to the first nip portion Np1 by the driven roller 53*a*, the frictional load acts larger than in the linear path.

Furthermore, in FIG. 5, assuming that P1 is the press-contact point of the paper feed transport roller pair 41, P2 is the contact point in which the driven roller 53*a* comes into contact with the periphery of the second roller 49, and that P3 is the contact point in which the driven roller 53*a* first comes into contact with the sheet shifting in the first transport path 32, the sheet transport length LS2 (the dashed-line length in FIG. 5) between P1 and P2 is set at a longer length than the sheet transport length (LS1: see FIG. 5) between P1 and P3, and thus set at LS2>LS1.

By this means, when the sheet fed by the paper feed transport roller pair 41 is guided to the first nip portion Np1 by the driven roller 53*a*, since LS2>LS1 is set, and the same time, V1>V2 is set, the sheet rear end portion is not pulled from the press-contact point P1 of the paper feed transport roller pair 41. Accordingly, the sheet is guided to the first nip portion Np1 with reference to the press-contact point P1 of the rear end portion.

Further, the velocities are set so that the following equation holds, assuming that LS3 is a stroke in which the driven roller 53*a* reaches the contact point P2 from the contact point P3.

$$(LS2-LS1)/V2 \approx LS3/V1 \quad \text{(Eq. 1)}$$

By this means, when the shift velocity of the driven roller 53*a* is slow, the point (contact point) P3 in contact with the sheet is displaced. Concurrently therewith, the slack occurs in the sheet in between the press-contact point P1 of the paper feed transport roller pair 41 and the driven roller 53*a*. The position displacement of the sheet engagement point and the slack of the sheet prevent the folding fluctuation, fold wrinkles and the like from occurring.

Then, in the second transport path 33, the sheet is carried in the upstream-side guide path (first switchback path) 34 by the carry-in roller pair 40 disposed in the first transport path 32 and register roller (first roller) 41*b*, and is carried to the downstream side by the first and second rollers 41*b*, 49.

The apparatus as shown in the figure is characterized by simplifying the sheet transport mechanism disposed in the first and second transport paths 32, 33, and reducing the size, noise and power consumption of the apparatus. Therefore, in the first transport path 32, part of the periphery of the folding roller (first roller 41*b*) disposed in the second transport path 33 is arranged to face the first transport path 32 in between the carry-in roller pair 40 and the carrying-out roller pair, 62*a*, 62*b*.

Then, the pinch roller 41*a* is disposed on the periphery of the first roller 41*b*, and the sheet fed from the carry-in roller pair 40 is thereby fed to the first switchback path 34. By this means, the need is eliminated for providing any particular transport roller in the second transport path 33, and it is achieved simplifying the transport mechanism.

[Folding Processing Form]

Figure 11A:
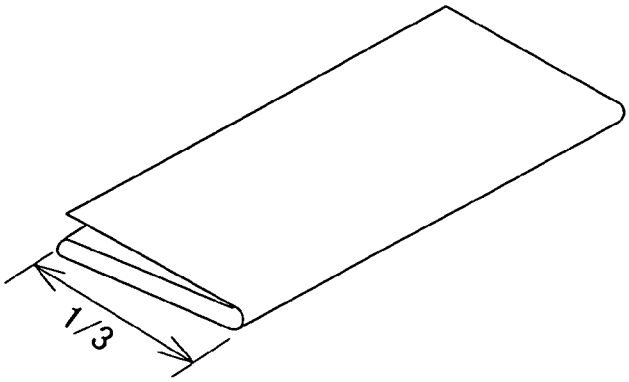
FIG. 11A shows an aspect for performing inward three-folding on the sheet in a ⅓ position.
Figure 11B:
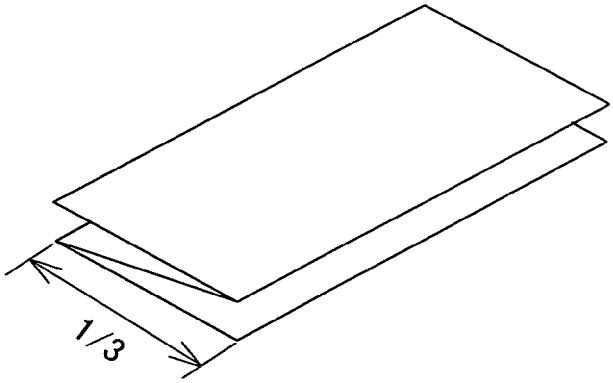
FIG. 11B shows an aspect for performing Z-folding on the sheet in a ⅓ position.
Figure 11C:
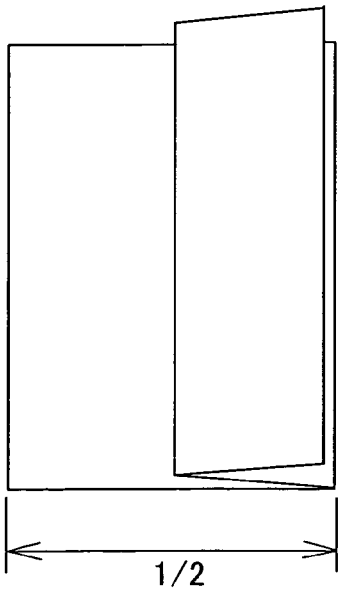
FIG. 11C shows an aspect for performing Z-folding on the sheet in a ¼ position.

A sheet folding method by the above-mentioned folding processing means 48 will be described next according to FIG. 11. In a normal sheet with the image formed, there are cases that the sheet is folded in two or three with a margin left for a filing finish, and that the sheet is folded in two or three for a letter finish. Further, in folding in three, there are cases of z-folding and inward three-folding. FIG. 11A shows inward three-folding, FIG. 11B shows ⅓ Z-folding, and FIG. 11C shows ¼ Z-folding.

Then, in the case of two-folding, the sheet fed to the second transport path 33 is folded in a ½ position of the sheet size or in a ½ position with a margin left in the sheet end portion by the first and second rollers 41*b*, 49 (first folding).

Meanwhile, in the case of three-folding, the sheet fed to the second transport path 33 is folded in a ⅓ position of the sheet size or in a ⅓ position with a margin left in the sheet end portion by the first and second rollers 41*b*, 49 (first folding). The second and third rollers 49, 50 fold the remaining sheet in a ⅓ position of the folded sheet (second folding) to feed to the third transport path 36.

Further, in the case of three-folding, when inward three-folding is performed as shown in FIG. 11A, the sheet fed to the second transport path 33 is folded in a ⅓ position on the sheet rear end side by the first and second rollers 41*b*, 49 and next, is folded in a ⅓ position on the sheet front end side.

Similarly, in the case of ⅓ Z-folding, the sheet fed to the second transport path 33 is folded in a ⅓ position on the sheet front end side by the first and second rollers 41*b*, 49 and next, is folded in a ⅓ position on the sheet rear end side.

Furthermore, in the case of three-folding, when z-folding is made in a ¼ position as shown in FIG. 11C, the sheet fed to the second transport path 33 is folded in a ¼ position on the sheet rear end side by the first and second rollers 41*b*, 49 and next, is folded in a ½ position of the sheet.

[Control Means]

The control means 95 for above-mentioned sheet folding is configured as described below. The sheet folding apparatus B as described previously is mounted with a control CPU, or a control section 91 of the image formation apparatus A is provided with a folding processing control section. Then, the control section is configured to enable the following operation.

First, the first switchback path 34 and second switchback path 35 of the second transport path 33 are provided with stopper means (not shown) for regulating the position of the sheet front end or sensor members (S1 and S2 shown in the figure) for detecting the position of the sheet front end.

In the apparatus as shown in the figure, the first sensor S1 is disposed in the first switchback path 34, and the second sensor 92 is disposed in the second switchback path 35. Then, the control means 95 is configured to calculate timing at which the fold position of the sheet arrives at a predetermined position from the sheet size information sent from the image formation apparatus A and a detection signal from the sensor S1 (S2).

Figure 12:
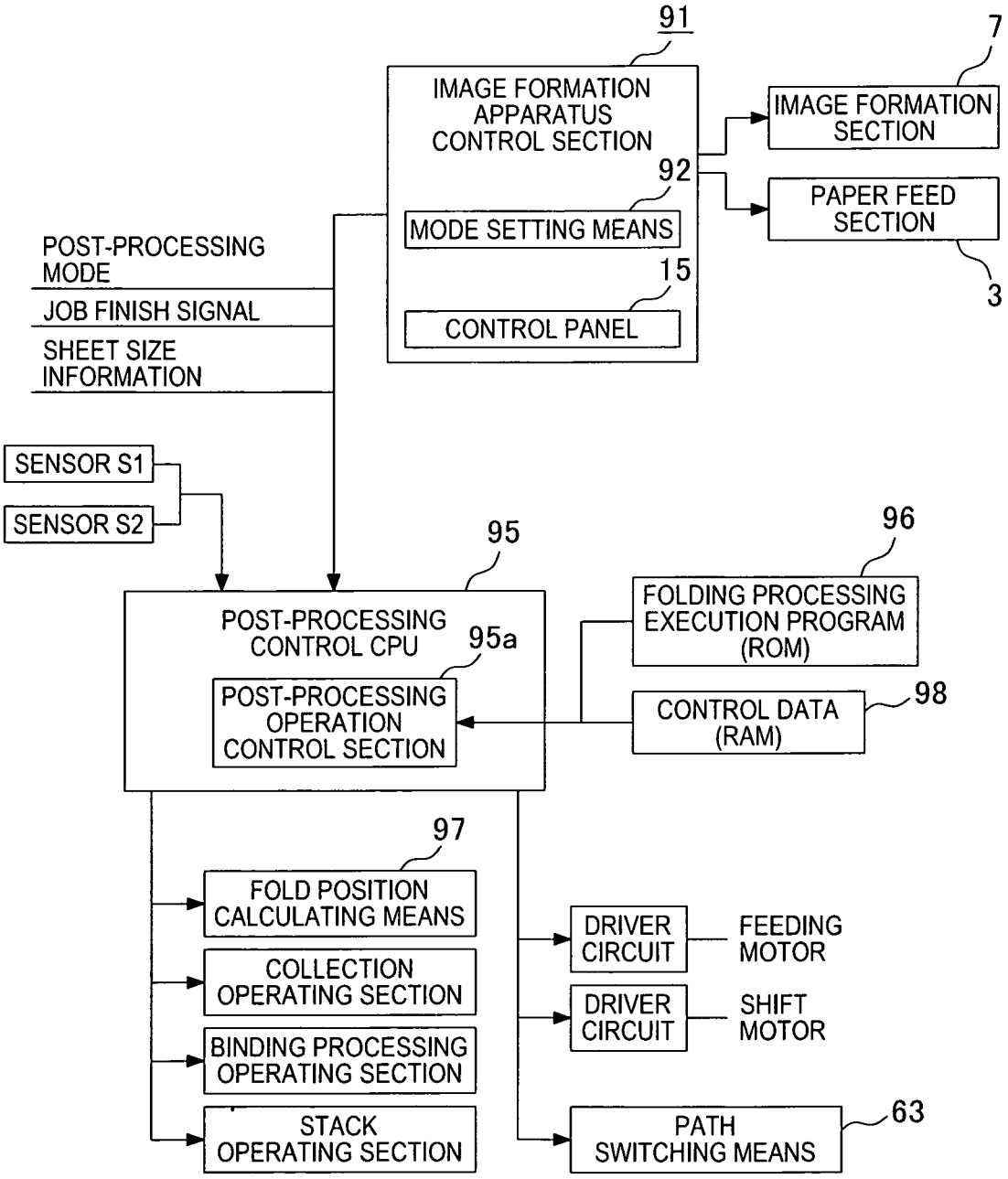
FIG. 12 is an explanatory view of a control configuration in the system of FIG. 1.

Then, the operation will be described according to the control block diagram shown in FIG. 12. In the image formation apparatus A, the control CPU 91 is provided with a control panel 15 and mode setting means 92. The control CPU 91 controls a paper feed section 3 and image formation section 7, corresponding to image formation conditions set in the control panel 15.

Then, the control CPU 91 transfers data and commands such as "post-processing mode", "job finish signal" and "sheet size information" required for post-processing to the control means 95 of the post-processing apparatus C.

The control means 95 of the post-processing apparatus C is a control CPU, and is provided with a post-processing operation control section 95*a*. Then, detection signals of the first sensor S1 and second sensor S2 are conveyed to the control CPU 95.

Meanwhile, the control CPU 95 conveys "ON"/"OFF" control signals to the driving means (solenoid: not shown in the figure) provided in the gate stopper 43 and the path switching means 63.

Then, for the control CPU 95, folding processing execution programs are stored in ROM 96 to control the feeding motor MF, shift motor MS; driving means and path switching means 63 so as to execute the folding forms as described previously. Further, RAM 98 stores data to calculate the fold of the sheet in fold position calculating means 97, and actuation timing time of the shift motor Ms as data.

The fold position calculating means 97 is comprised of a computing circuit for calculating a fold position (dimension) from the sheet front end (front end in the sheet discharge direction), from the "sheet length size", "folding form" and "margin dimension". For example, in the two-folding mode, the sheet is folded in a ½ position in the sheet discharge direction, or a ½ position with a beforehand set margin left. For example, calculation of the fold position is obtained by calculating [{(sheet length size)−(margin)}/2].

Further, in the three-folding mode, for example, the fold position is calculated corresponding to the folding form such as letter folding (inward three-folding, ⅓ Z-folding) and filing folding (¼ Z-folding, ⅓ Z-folding).

[Folding Processing Operation]

Figure 6A:
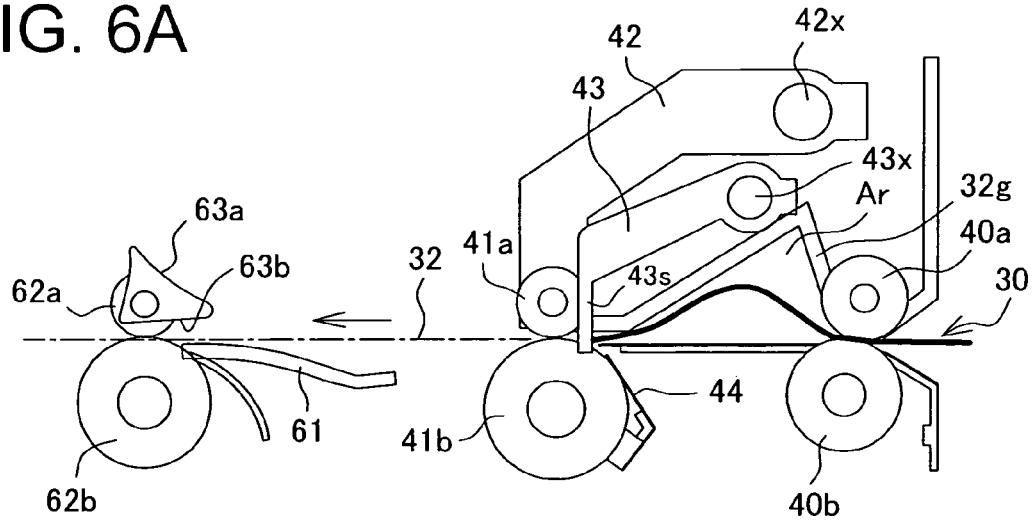
FIG. 6A shows a register state of the sheet.

The action in the configuration of the sheet folding apparatus B will be described. FIG. 6A shows a state in which a sheet entering the carry-in entrance 30 undergoes register correction, and FIG. 6B shows a state in which the sheet is carried in the first switchback path 34 for first folding.

Figure 7A:
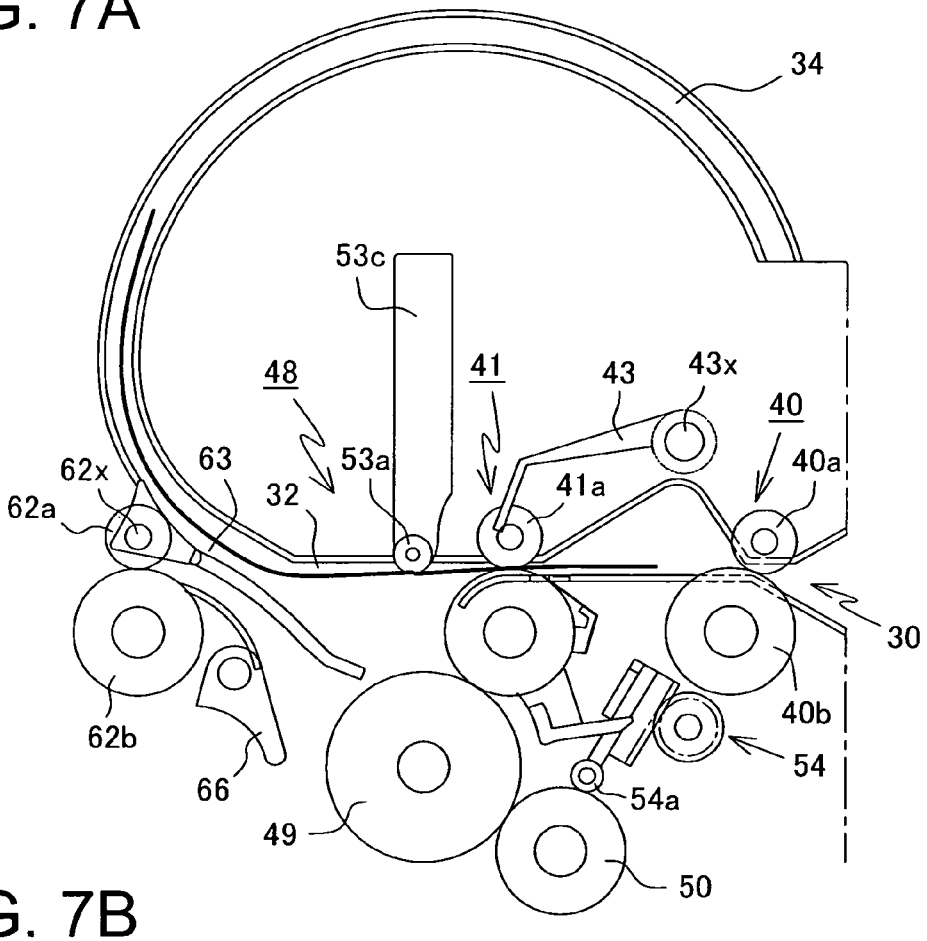
FIG. 7A shows a state in which the deflecting member comes into contact with the sheet.
Figure 7B:
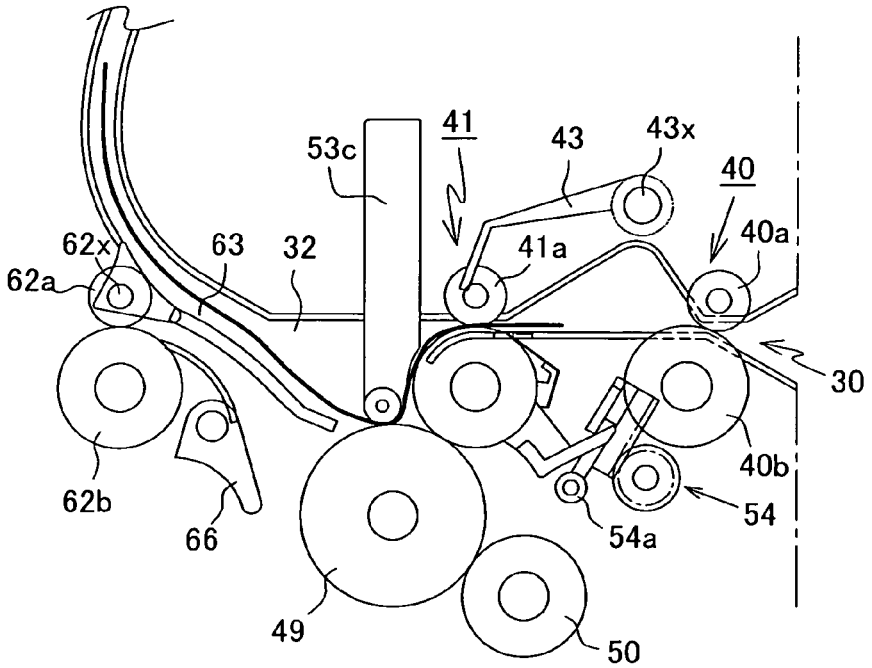
FIG. 7B shows a state in which a fold position of the sheet is inserted in a first nip portion.
Figure 8A:
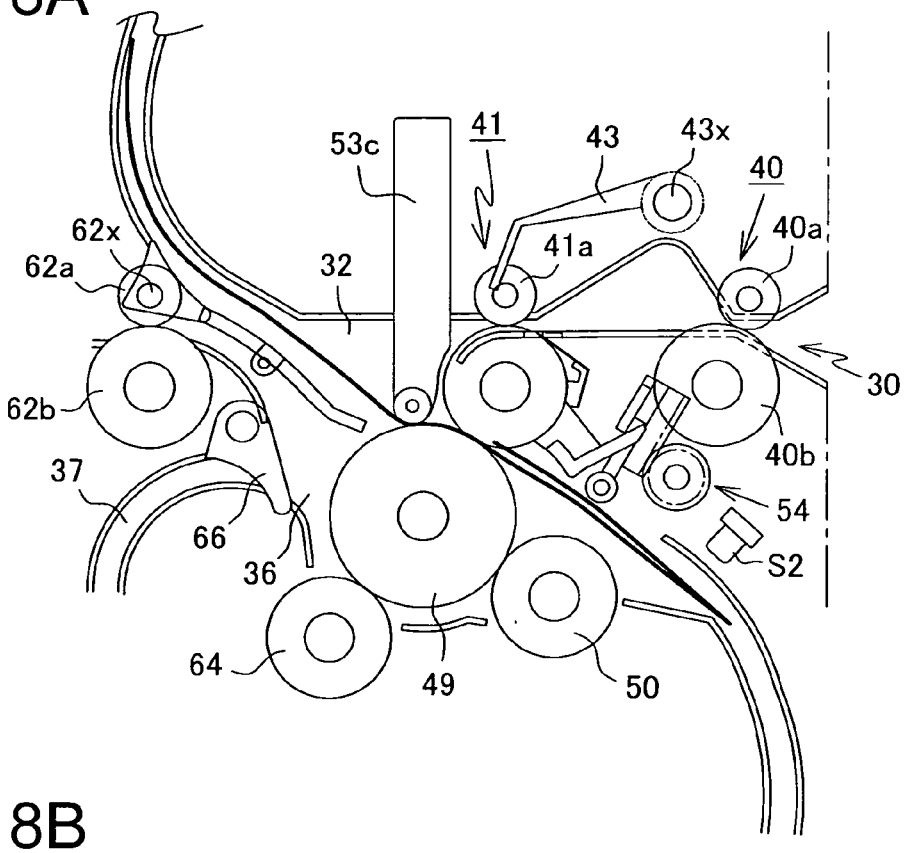
FIG. 8A shows a state in which the first-folded sheet is transported to a second switchback path.
Figure 8B:
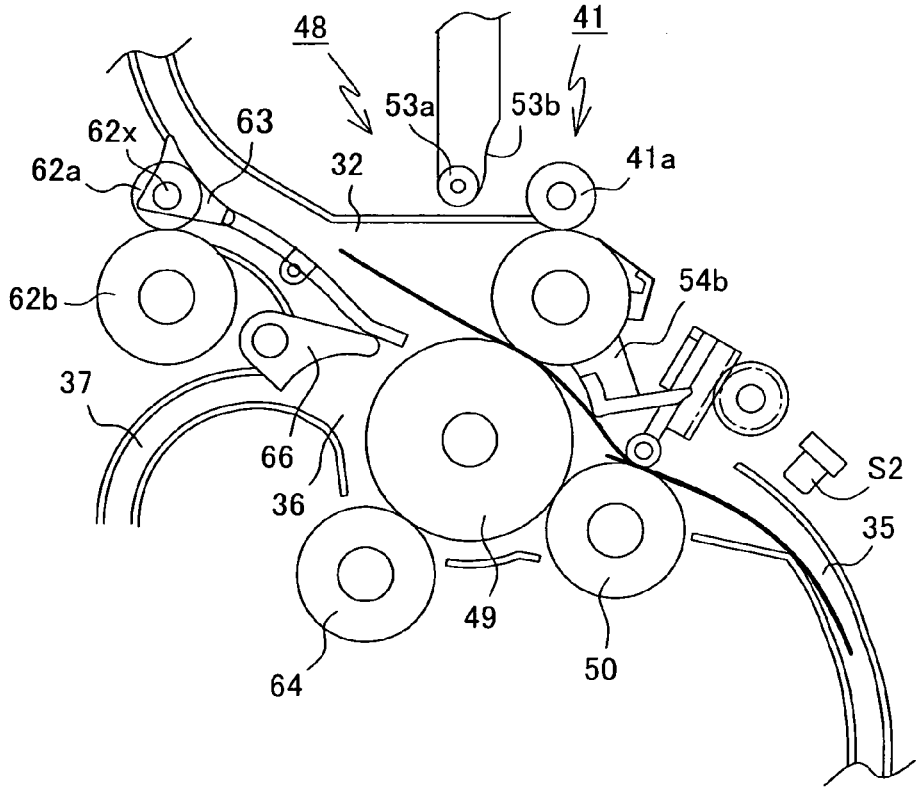
FIG. 8B shows an initial state in which the sheet is second folded in a second nip portion.
Figure 9A:
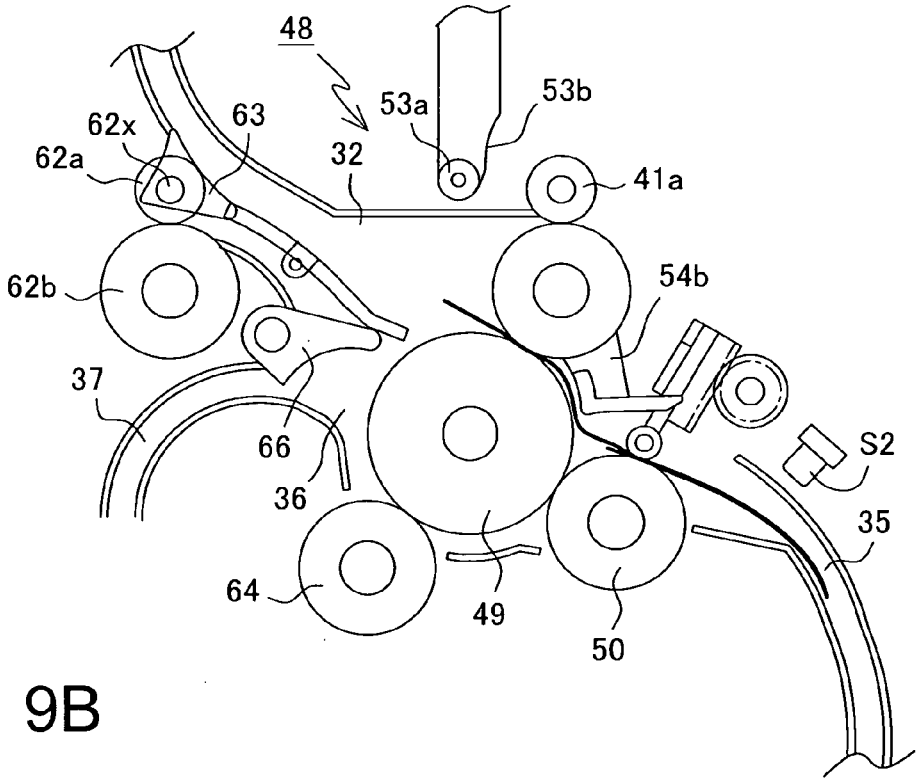
FIG. 9A shows a state in which a fold position of the sheet is inserted in the second nip portion.
Figure 9B:
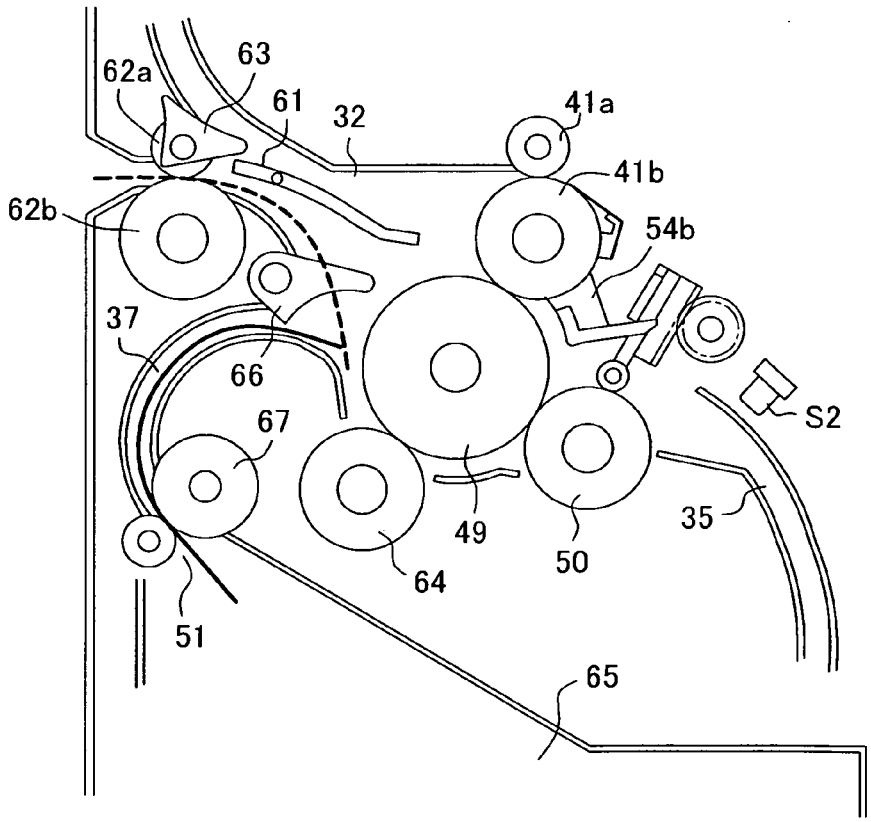
FIG. 9B shows a state in which the folded sheet is carried out in the sheet discharge direction.

FIG. 7A shows a state in which the driven roller 53*a* comes into contact with the sheet, FIG. 7B shows a state in which the sheet is folded in the first folding position Np1, FIG. 8A shows a state in which the folded sheet is carried in the second switchback path 35, FIG. 8B shows a state in which the driven roller 54*a* comes into press-contact, FIG. 9A shows a state in which the sheet is folded in the second folding position Np2, and FIG. 9B is a state in which the folded sheet is carried out.

In FIG. 6A, a sheet is guided to the carry-in entrance 30, and fed to the downstream side by the carry-in roller pair 40. At this point, the control means 95 controls the gate stopper 43 to be positioned in a lock position. Then, the sheet front end is locked by the lock surface 43*s* of the stopper member, and the sheet is curved and deformed in the shape of a loop inside the register area, and at this point, aligned in the front end according to the lock surface 43*s*. Next, the control means 95 retracts the gate stopper 43 from the lock position to the waiting position.

Figure 6B:
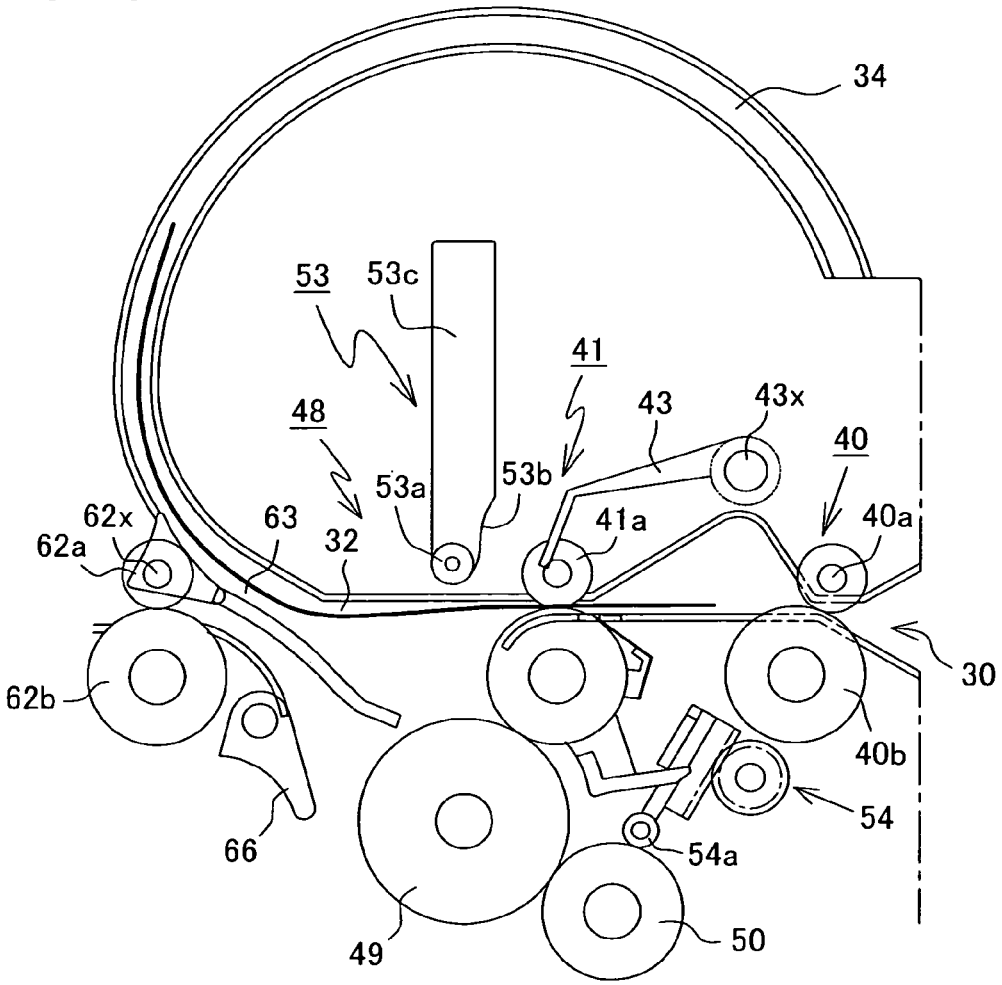
FIG. 6B shows a state in which the sheet is carried from a first transport path to a second transport path.

In FIG. 6B, the control means 95 shifts the gate stopper 43 from the lock position to the waiting position. Then, the sheet is fed to the downstream side in the first transport path 32 by the above-mentioned sheet transport mechanism. Then, the control means 95 controls the path switching means 63 so as to guide the sheet to the first switchback path 34 from the first transport path 32 as shown in FIG. 6B.

Thus, the sheet is carried in the first switchback path 34 by the paper feed transport member 41. In addition, in the first transport path 32, the first sensor S1 is disposed on the downstream side of the pinch roller 41*a* and the first roller 41*b*, and detects the sheet front end carried in the first switchback path 34.

In FIG. 7A, based on a signal such that the first sensor S1 detects the sheet front end, the control means 95 shifts the up-and-down member 53*c* of the first folding deflecting member 53 from the waiting position to the actuation position at timing at which the fold position of the sheet is shifted to a predetermined position. In the process, the driven roller 53*a* comes into contact with the sheet.

By setting the shift velocity of the driven roller 53*a* at a higher velocity than the transport velocity of the sheet fed from the first transport path 32, distortion does not occur in the sheet when the driven roller 53*a* guides the fed sheet to the nip portion Np1 of the folding roller pair.

Then, without deviating the contact point P3 in which the fed sheet first comes into contact with the driven roller 53*a*, the driven roller 53*a* brings the sheet into contact with the contact point P2 in contact with the periphery of the second roller 49, and it is thus possible to position the accurate fold position in the roller nip portion without any wrinkle occurring in the sheet.

In FIG. 7B, the sheet in the first transport path 32 is deformed in the shape of a V toward the first nip portion Np1. Then, when the driven roller 53*a* attached to the up-and-down member 53*c* comes into press-contact with the periphery of the second roller 49, the sheet front end side is fed in the opposite direction (rotation direction of the second roller 49).

Meanwhile, the sheet rear end side feeds the sheet toward the first nip portion Np1 by transport force of the pinch roller 41*a* and the first roller 41*b*. At this point, the curved guide surface of the curved guide 53*b* regulates the sheet to follow the roller periphery of the first roller 41*b*.

Accordingly, the sheet is fed toward the first folding position Np1 on the front end side by the driven roller 53*a* and on the rear end side by the pinch roller 41*a* and the first roller 41*b*, and up-and-down timing of the up-and-down member 53*c* is to calculate the fold position.

Therefore, the control means 95 beforehand sets the velocity for shifting the sheet by the pinch roller 41*a* and the first roller 41*b* and the timing (particularly, timing at which the driven roller 53*c* comes into contact with the periphery of the second roller 49) for shifting the driven roller 53*a* to the actuation position from the waiting position at optimal values by experiments.

Then, the curved guide surface of the curved guide 53*b* guides the sheet to follow the periphery of the opposed first roller 41*b* in synchronization with the shift of the driven roller 53*a* from the waiting position to the actuation position, and therefore, there is no fear that the fold position of the sheet changes every time.

In FIG. 8A, the sheet folded in the ½ position (two-folding), ⅓ position (three-folding) or ¼ position (three-folding) in the first nip portion Np1 is provided with the transport force by the first nip portion Np1 and fed to the downstream side.

Then, the control means 95 positions the up-and-down member 54*c* of the second folding deflecting member 54 in the actuation position in the two-folding mode, or in the waiting position in the three-folding mode.

FIG. 8A shows control of the three-folding mode. In two-folding, the up-and-down member 54*c* is positioned in the actuation position, and the folded sheet is guided to the second nip portion Np2 beginning with the front end, and is fed to the carrying-out exit 31 on the downstream side.

Then, in the three-folding mode, the control means 95 positions the up-and-down member 54*c* of the second folding deflecting member 54 in the waiting position as shown in FIG. 8A. Thus, the sheet fed from the first nip portion Np1 is fed to the second switchback path 35 beginning with the front end. Then, the second sensor S2 detects the sheet front end (fold position).

In FIG. 8B, with reference to a detection signal of the second sensor S2, in a stage in which the fold position for second folding arrives at a predetermined position, the control means 95 shifts the up-and-down member 54*c* of the second folding deflecting member 54 from the waiting position to the actuation position. Then, the sheet inside the second switchback path 35 is fed in the opposite direction in a stage in which the driven roller 54*c* comes into contact with the periphery of the third roller 50.

By this means, as shown in FIG. 9A, the sheet is guided to the second nip portion Np2 by the front end side sending the sheet by the driven roller 54*a* and the rear end side sending the sheet by the first nip portion Np1 in respective opposite directions. In addition, in this case, the shift timing of the up-and-down member 54*c* from the waiting position to the actuation position is the same as in the case of the first folding deflecting member 53 as described previously, and the action of the guide member 54*b* is also the same as in the case.

In FIG. 9B, in the folded sheet fed to the second folding position Np2, the fold is reliably folded by the folding enhancement roller 64 coming into press-contact with the second roller 49, and the sheet is carried to the third transport path 36. Then, the control means 95 feeds the folded sheet to the sheet discharge path 37 or feeds the sheet back to the first transport path 32 corresponding to the beforehand set sorting form.

In the apparatus as shown in the figure, in inward three-folding and ⅓ Z-folding of the letter folding form with no need of binding in the post-processing apparatus C, the control means 95 controls a path switching flapper 66 to guide the sheet from the sheet discharge path 37 to the storage stacker 65.

Meanwhile, in the two-folding mode and three-folding mode of ¼ Z-folding or the like for filing or with the need of the post-processing such as bookbinding processing, the sheet is carried to the first transport path 32 from the third transport path 36, and fed to the post-processing apparatus C from the carrying-out exit 31.

[Folding Operation in the Two-Folding Mode]

Figure 13:
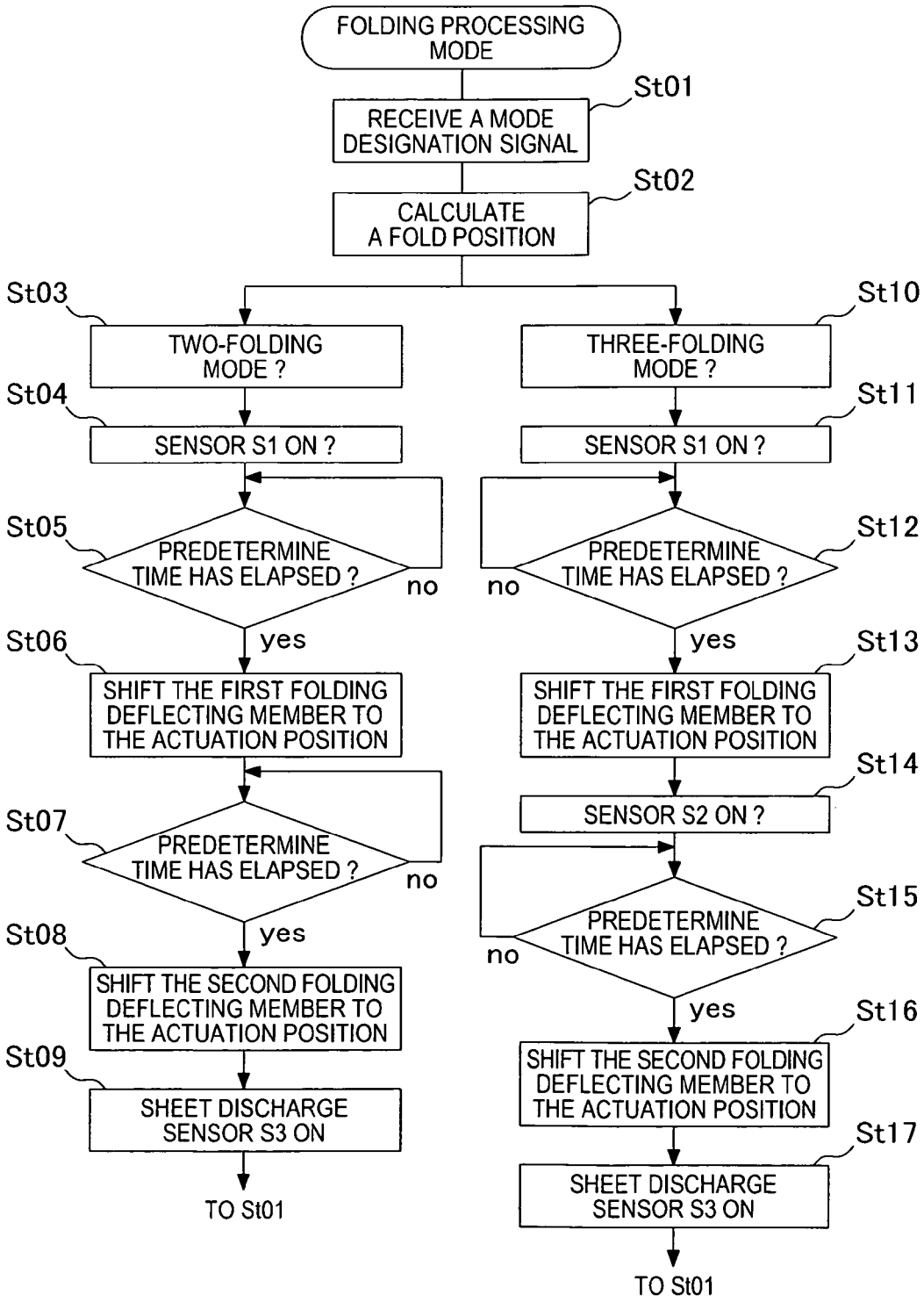
FIG. 13 is a flowchart illustrating processing operation in the control configuration of FIG. 12.

In the above-mentioned folding operation, in the mode for folding the sheet in two, as shown in FIG. 13, the control means 95 receives a mode instruction signal of whether or not to perform folding processing concurrently with a sheet discharge instruction signal from the image formation apparatus A (St01). Next, the control means 95 calculates the fold position in the fold position calculating means 97 (St02). Then, in the two-folding mode (St03), the first sensor S1 detects the sheet front end (St04). This shift is controlled by rotation of the shift motor MS.

After a lapse of sheet feeding time corresponding to the sheet length calculated in the fold position calculating means 97 from the detection signal (St05), the control means 95 shifts the first folding deflecting member 53 from the waiting position to the actuation position (St06). This shift is controlled by rotation of the shift motor MS.

In the process during which the up-and-down member 53*c* of the first folding deflecting member 53 shifts to the actuation position, as described in FIG. 7B, the sheet in the first transport path 32 is distorted toward the first nip portion Np1 with reference to the fold position. Then, when the driven roller 53*a* of the first folding deflecting member 53 comes into contact with the periphery of the second roller 49, the sheet is drawn and inserted in the first nip portion Np1 beginning with the fold position.

At this point, in the two-folding mode, after a lapse of predicted time that the fold of the sheet is inserted in the first nip portion Np1 with reference to a detection signal from the first sensor S1 (St07), the control means 95 shifts the second folding deflecting member 54 to the actuation position (St08). The predicted time is set at time elapsed before the front end of the folded sheet arrives at the curved guide 54*b* after the fold position of the sheet is inserted in the first nip portion Np1.

Accordingly, the front end of the folded sheet is guided by the curved guide surface of the curved guide 54*b* and is brought along the second roller periphery in the state as shown in FIG. 9A.

Concurrently therewith, since the driven roller 54*a* positioned in the actuation position rotates according to rotation of the third roller 50, even when the front end of the folded sheet is curled in the direction departing from the second nip portion Np2, the sheet is reliably guided to the second nip portion Np2 by the rotation of the driven roller 54*a* and third roller 50.

Then, the control means 95 carries the folded sheet, which is fed from the second nip portion Np2 to the third transport path 36, to the first transport path 32 from the third transport path 36. Next, the control means 95 prepares for processing of a subsequent sheet in a state in which the second folding deflecting member 54 is positioned in the actuation position (St09).

In the apparatus as shown in the figure, in relation to the first folding deflecting member 53 positioned in the waiting position, the second folding deflecting member 54 shifting to positions in a relatively opposite manner is positioned in the actuation position, but it is also possible to configure so that the second folding deflecting member 54 shifts to the waiting position by a detection signal of a sheet discharge sensor S3 disposed in the third transport path 36.

[Folding Operation in the Three-Folding Mode]

In the mode for folding the sheet in three, as described in FIGS. 7 to 9, the control means 95 receives a mode instruction signal of whether or not to perform folding processing concurrently with a sheet discharge instruction signal from the image formation apparatus A (St01). Next, the control means 95 calculates the fold position in the fold position calculating means 97 (St02). Then, in the three-folding mode (St10), the first sensor S1 detects the sheet front end (St11). This shift is controlled by the shift motor MS.

In the process during which the up-and-down member 53*c* of the first folding deflecting member 53 shifts to the actuation position, as described in FIG. 7B, the sheet in the first transport path 32 is distorted toward the first nip portion Np1 with reference to the fold position.

Then, when the driven roller 53*a* of the first folding deflecting member 53 comes into contact with the periphery of the second roller 49, the sheet is drawn and inserted in the first nip position Np1 beginning with the fold position. At this point, in the three-folding mode, the control means 95 waits for the second sensor S2 to detect the sheet front end (St14).

After a lapse of predicted time that the second-folding fold position of the sheet arrives at a predetermined position with reference to a detection signal such that the second sensor S2 detects the sheet front end (St15), the control means 95 shifts the second folding deflecting member 54 to the actuation position (St16). The predicted time is set at a calculation value of the fold position calculating means 97. Then, the sheet is given the transport force from the driven roller 54*a* and is inserted in the second nip portion Np2. The sheet discharge sensor S3 detects the sheet front end, and the sheet is carried out to the first transport path 32 from the third transport path 36, or carried out to the storage stacker 65 from the sheet discharge path 37 corresponding to the folding form (St17).

[Configuration of the Sheet Discharge Path]

The folded sheet that is folded in two or three as described above is fed to the third transport path 36 from the press-contact point of the second and third rollers 49, 50. Then, the sheet is further folded by the folding enhancement roller 64 in press-contact with the second roller 49, and guided to the third transport path 36.

The third transport path 36 merges with the first transport path 32 as described previously. The sheet discharge path 37 branches off from the third transport path 36, is provided via the path switching flapper 66, and guides the folded sheet to the storage stacker 65 disposed below the second transport path 33. The sheet discharge path 37 has the curvature R3 and is configured as described previously. "67" shown in the figure denotes the sheet discharge roller disposed in the sheet discharge path 37.

Accordingly, the sheet with no need of carrying to the post-processing apparatus C e.g. the sheet folded in the letter form such as inward three-folding and ⅓ Z-folding is stored in the storage stacker 65 without being carried to the carrying-out exit 31.

Then, in the folded sheet fed to the third transport path 36, the sheet to feed to the post-processing apparatus C for post-processing is carried toward the carrying-out exit 31 by the carrying-out roller pair 62*a*, 62*b*. In addition, in this case, determination whether or not to perform post-processing is configured to be made by setting the post-processing condition concurrently with the image formation conditions in the control panel 15. Then, it is configured that the sheet is carried out to the storage stacker 65 or carried to the post-processing apparatus C corresponding to the set finish condition.

[Image Formation Apparatus]

The image formation apparatus A is provided with the following configuration as shown in FIG. 1. In this apparatus, the paper feed section 3 feeds a sheet to the image formation section 7, the image formation section 7 prints in the sheet, and the sheet is carried out of the main-body sheet discharge outlet 18. The paper feed section 3 stores sheets of a plurality of sizes in paper cassettes 4*a*, 4*b*, and separates designated sheets on a sheet-by-sheet basis to feed to the image formation section 7. In the image formation section 7, for example, an electrostatic drum 8, and a printing head (laser emitting device) 9, developing device 10, transfer charger 11 and fuser 12 arranged around the drum 8 are disposed, the laser emitting device 9 forms an electrostatic latent image on the electrostatic drum 8, the developing device 10 adds toner to the image, the transfer charger 11 transfers the image onto the sheet, and the fuser 12 heats and fuses the image.

The sheet with the image thus formed is sequentially carried out of the main-body sheet discharge outlet 18. "13" shown in the figure denotes a circulating path, and is a path for two-side printing for reversing the side of the sheet printed on the front side from the fuser 12 via a main-body switchback path 14, then feeding the sheet to the image formation section 7 again, and printing on the back side of the sheet. Thus two-side printed sheet is carried out of the main-body sheet discharge outlet 18 after the side of the sheet is reversed by the main-body switchback path 14.

"20" shown in the figure denotes an image reading section, scans an original document sheet set on a platen 21 with a scan unit 22, and electrically reads the sheet with a photoelectric conversion element not shown. For example, the image data is subjected to digital processing in an image processing section, and then, transferred to a data storing section 16, and an image signal is sent to the laser emitting device 9. Further, "25" shown in the figure denotes a feeder apparatus, and feeds original document sheets stored in a stacker 26 to the platen 21.

The image formation apparatus A with the above-mentioned configuration is provided with a control section (controller) not shown, and image formation conditions such as, for example, sheet size designation and color/monochrome printing designation and printout conditions such as number-of-copy designation, one-side/two-side printing designation, and scaling printing designation are set from the control panel 15.

Meanwhile, the image formation apparatus A is configured so that image data read by the scan unit 22 or image data transferred from an external network is stored in the data storing section 16, the data storing section 16 transfers the image data to buffer memory 17, and that the buffer memory 17 transfers a data signal to the printing head 9 sequentially.

Concurrently with the image formation conditions, a post-processing condition is also input and designated from the control panel 15. As the post-processing condition, for example, selected is a "printout mode", "staple binding mode", "sheet-bunch folding mode" or the like. The post-processing condition is set for the folding form in the sheet folding apparatus B as described previously.

[Post-Processing Apparatus]

As shown in FIG. 1, the post-processing apparatus C is provided with the following configuration. This apparatus has an apparatus housing 68 provided with the sheet receiving opening 69, sheet discharge stacker 70, and post-processing path 71. The sheet receiving opening 69 is coupled to the carrying-out exit 31 of the sheet folding apparatus B as described previously, and is configured to receive a sheet from the first transport path 32 or the third transport path 36.

The post-processing path 71 is configured to guide the sheet from the sheet receiving opening 69 to the sheet discharge stacker 70, and a processing tray 72 is provided in the path. "73" shown in the figure denotes a sheet discharge outlet, and is to collect sheets from the post-processing path 71 in the processing tray 72 disposed on the downstream side. "74" shown in the figure denotes a punch unit, and is disposed in the post-processing path 71. A sheet discharge roller 75 is disposed in the sheet discharge outlet 73 to collect a sheet from the sheet receiving opening 69 in the processing tray 72.

On the processing tray 72, sheets from the post-processing path 71 are switch-back transported (in the direction opposite to the transport direction), and collated and collected using a rear end regulating member (not shown) provided on the tray. Therefore, above the tray is provided a forward/backward rotation roller 75 for switching back the sheet from the sheet discharge outlet 73. Further, the processing tray 72 continues to the sheet discharge stacker 70, and the sheet from the sheet discharge outlet 73 is supported (bridge-supported) on the front end side by the sheet discharge stacker 70 and on the rear end side by the processing tray 72.

On the processing tray 72 is disposed a stapler unit 77 for binding a bunch of sheets positioned by the rear end regulating member. Then, the bunch of sheets loaded on the try 72 is stapled, and then, carried out to the sheet discharge stacker 70. The sheet discharge stacker 70 shown in the figure is provided with an elevator mechanism (not shown) which moves up and down corresponding to a load amount of sheets.

[Shift Start Timing of the Folding Deflecting Member]

As described above based on FIGS. 1 to 13, the shift velocity V1 of the first folding deflecting member 53 is set at a higher velocity than the velocity V2 of the sheet shifting in the first transport path 32. In addition thereto, the shift start timing of the first folding deflecting member 53 will be described based on FIGS. 14 to 16.

Figure 14A:
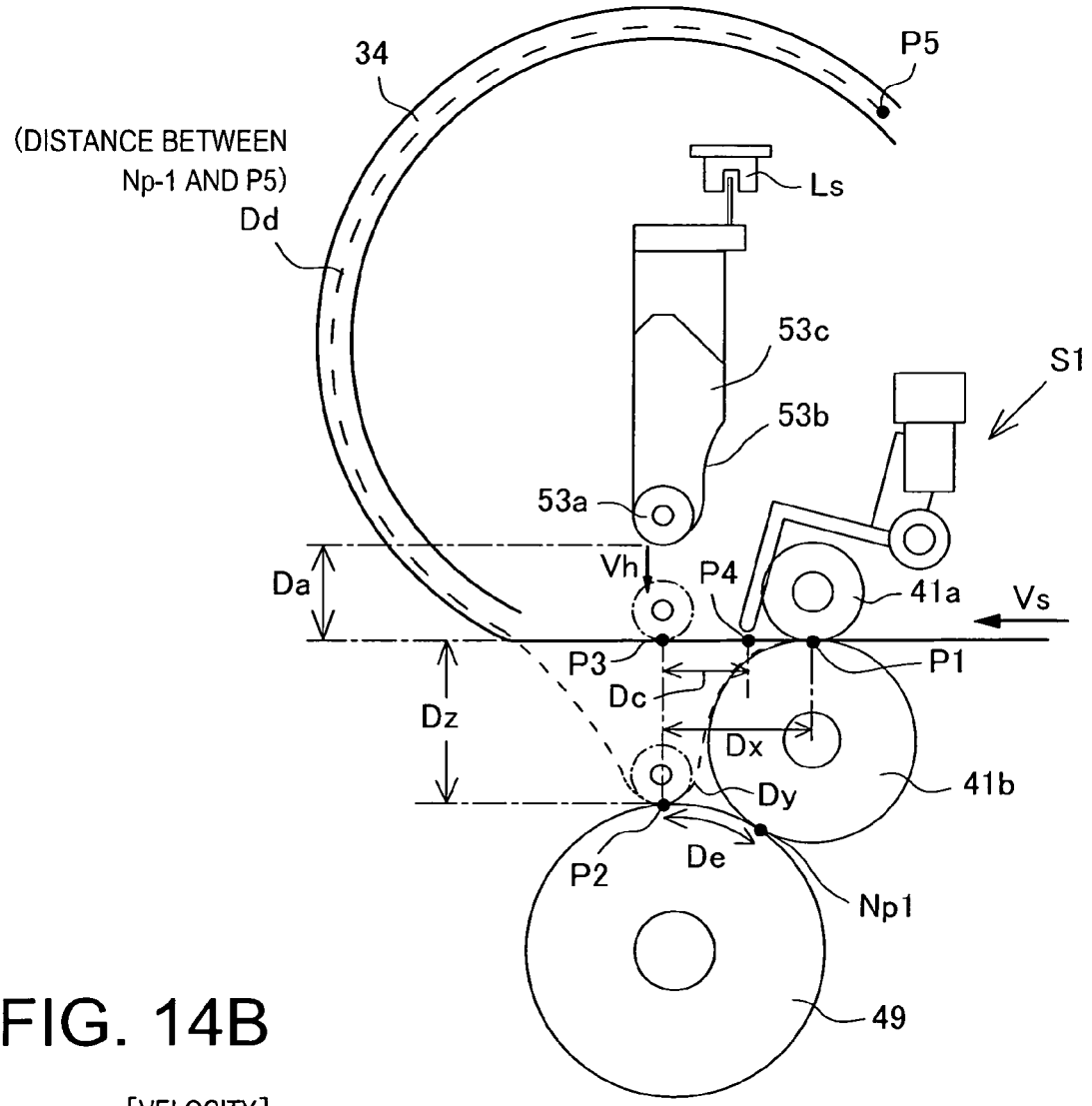
FIG. 14 is a second conceptual diagram illustrating the relationship between the shift velocity of the deflecting member and the sheet transport velocity.
Figure 14B:
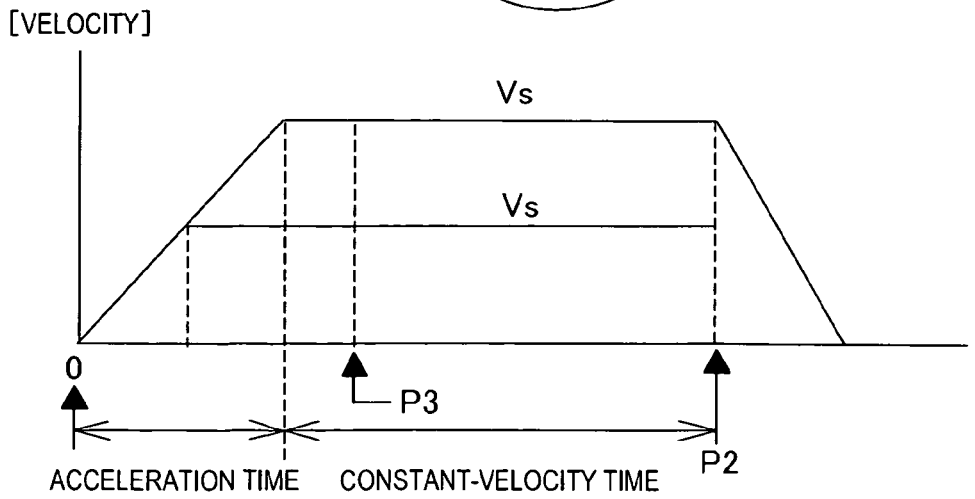

First, the description is given using FIG. 14. In FIG. 14, the sheet velocity V2 shown in FIG. 5 is shown by the sheet velocity Vs, the shift velocity V1 of the first folding deflecting member 53 is shown by the shift velocity Vh, and the same configuration as in FIG. 5 is assigned the same reference numeral to omit the description thereof. Further, in FIG. 14, it is shown that the sheet transport length between P1 and P2 is Dy, the sheet transport length between P1 and P3 is Dx, and that a stroke for the driven roller 53*a* to travel to the contact point P2 from the contact point P3 is Dz.

In the invention, the carry-in roller pair 40 carries a sheet in the apparatus at the velocity equal to the sheet transport velocity Vs of the sheet fed from the image formation apparatus A on the upstream side. By this means, the sheet is fed to the folding processing means 48 at the same velocity as the image formation velocity. In this case, the sheet fed from the image formation apparatus A is fed at a very wide range of velocities corresponding to the image formation condition.

Therefore, the invention provides calculating means 99 for calculating the sheet deflecting velocity Vh to shift the first folding deflecting member 53 from the waiting position Wp to the actuation position Ap and shift start timing of the first folding deflecting member 53, based the sheet velocity Vs of the sheet fed from the image formation apparatus A on the upstream side, and timing (detection signal from the front end detecting member) at which the sheet front end arrives at a predetermined position (position of the first sensor S1).

The calculating means 99 sets the sheet deflecting velocity Vh by the first folding deflecting member 53 at a higher velocity than the sheet transport velocity Vs by the carry-in roller pair 40 in a certain magnification relationship. In the apparatus shown in the figure, it is set that Vh=1.7 Vs. As shown in FIG. 14, since the sheet transport direction (horizontal direction in FIG. 14) is a substantially orthogonal direction to the sheet deflecting velocity (vertical direction in FIG. 14), this velocity ratio is set from experimental values so that the transport force actually acted on the sheet is the same in both velocities, or Vh is slightly larger (higher) than Vs.

By this means, the sheet shifts at the velocity of the carry-in roller pair 40, the velocity acted on the sheet is set so that sheet deflecting velocity Vh>sheet transport velocity Vs, and therefore, without deviating the point in which the driven roller 53*a* of the first folding deflecting member 53 comes into contact with the sheet, it is possible to bring into contact with the second roller 49. In addition, the transport velocity of the paper feed transport roller pair 41 is set at the velocity in agreement with the velocity Vs of the carry-in roller. Accordingly, the shift start timing of the deflecting member described later is capable of being calculated based on the velocity of the paper feed transport roller pair 41.

Then, time (delay time from the detection signal of the first sensor S1) Tx for the first folding deflecting member 53 to start to shift from the waiting position is calculated using the following equation from timing at which the sheet front end detecting member (first sensor) S1 detects the sheet front end.

$$Vh=1.7\,Vs \quad \text{(Eq. 3)}$$

$$Tx=Tb-Ta \quad \text{(Eq. 4)}$$

In this case, "Ta" is the time lapsed until the first folding deflecting member 53 arrives at the contact point P in which the member 53 first comes into contact with the sheet after starting to shift from the waiting position Wp, and is the sum of the acceleration time and constant-velocity time of the shift motor MS. Herein, the constant-velocity time of the shift motor MS is obtained from (Da-acceleration distance)/Vh. The "Da" is the shift distance of the first folding deflecting member 53, and for the "acceleration distance", the cumulative acceleration distance is calculated from a control table of the motor and a stepping amount per pulse (for example, (the number of power supply pulses)×(stepping amount per pulse) until the velocity reaches the predetermined velocity).

Further, "Tb" is obtained by the following equation.

$$Tb=Db/Vs \quad \text{(Eq. 5)}$$

$$Db=Dc+(Dd-De) \quad \text{(Eq. 6)}$$

"Dc" in Eq. 6 is the distance between the sensor detection position P4 and the position P3 in which the first folding deflecting member 53 first comes into contact with the sheet, and "Dd" is the distance between the first folding position Np1 and the sheet front end P5. Further, "De" is the distance between the first folding position Np1 and the contact point P2 in contact with the periphery of the second roller 49.

Thus, the shift velocity (sheet defecting velocity) Vh of the driven roller 53*a* and the shift start timing is calculated based on the front end detection signal such that the sheet shifting in the first transport path 32 arrives at the predetermined position, and the sheet velocity Vs. Therefore, even when the velocity Vs of the sheet in the first transport path 32 varies from the high velocity to the low velocity in the wide range, the sheet undergoes the folding processing at the folding processing velocity (sheet deflecting velocity) Vh adapted to the sheet transport velocity Vs.

For example, in an apparatus configuration for performing folding processing on sheets fed from an image formation apparatus, even when the velocity for image formation varies corresponding to the image formation condition or an apparatus configuration (difference in the sheet transport length)

of the image formation section and sheets are fed at various transport velocities corresponding thereto, the sheet undergoes the folding processing in the folding processing position on the downstream side corresponding to the sheet transport velocity. Accordingly, in the case of a system configuration in which the folding processing apparatus B of the invention is disposed on the downstream side of the image formation apparatus A, it is possible to guide the sheet to the folding processing means 48 corresponding to the transport velocity Vs of the sheet fed from the image formation apparatus A on the upstream side. In addition, when there is a velocity difference between the transport velocity Vs of the sheet fed from the image formation apparatus A and the circumferential velocity of the paper feed transport roller pair 41, the sheet deflecting velocity Vh and shift start timing is calculated corresponding to the circumferential velocity of the paper feed transport roller pair 41.

Figure 15:
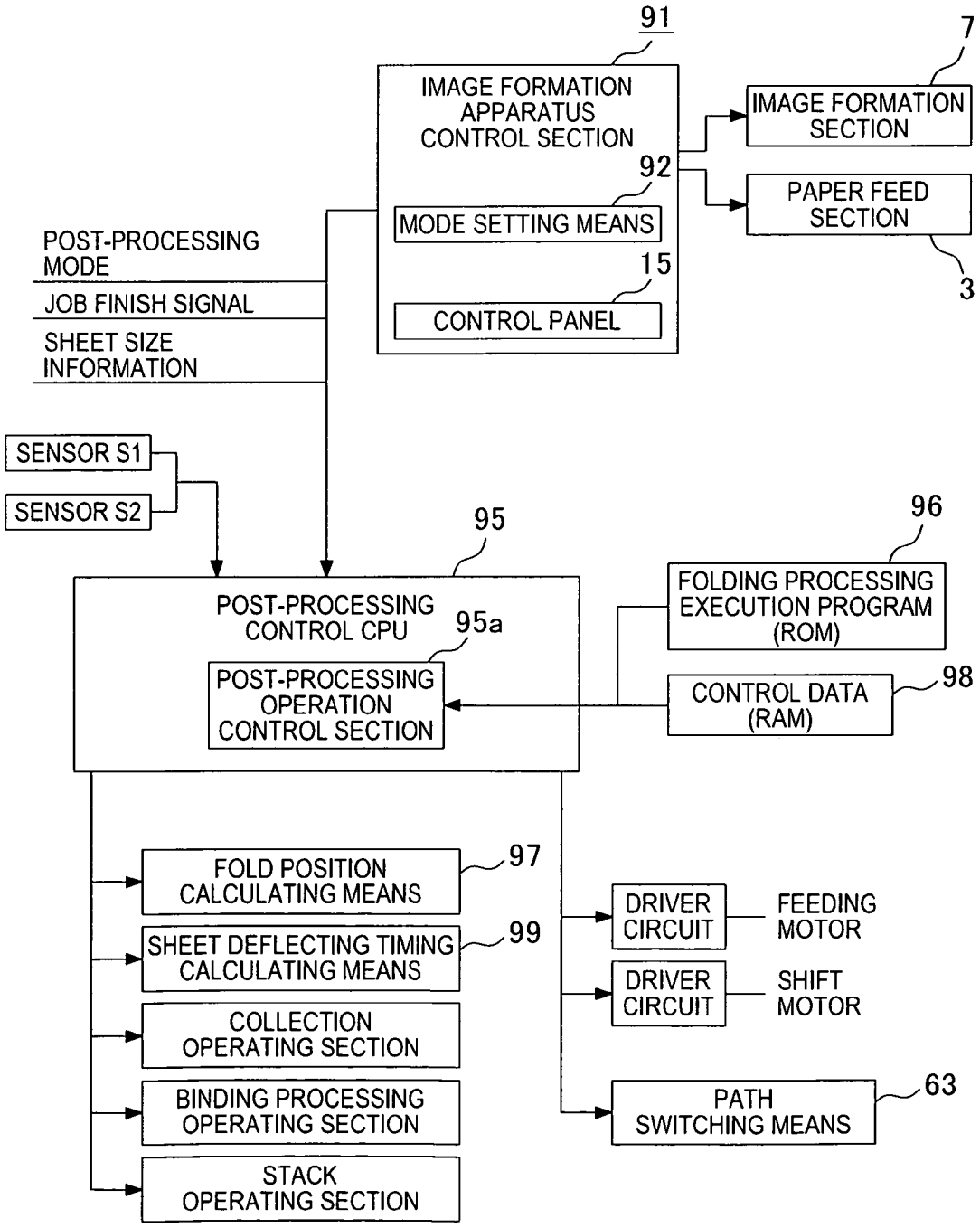
FIG. 15 is a second explanatory view of the control configuration in the system of FIG. 1.

As shown in FIG. 15, the control CPU 95 is provided with the calculating means (sheet deflecting timing calculating means) 99 that calculates the operation timing of the first folding deflecting member 53 as described previously, and the calculating means calculates the delay time (Tx described previously) to start the first folding deflecting member 53 from a detection signal such that the first sensor S1 detects the sheet front end. The calculation method is as described previously. In addition, the other configuration is the same as in FIG. 12, and the same reference numerals are assigned to omit descriptions thereof.

Further, FIG. 16 is obtained by adding, to FIG. 13 described above, steps (see FIG. 16: St05, St13) of calculating the operation timing of the first folding deflecting member 53 by the sheet deflecting timing calculating means 99 after the first sensor S1 detects the sheet (see FIG. 13: St04, St11).

Figure 16:
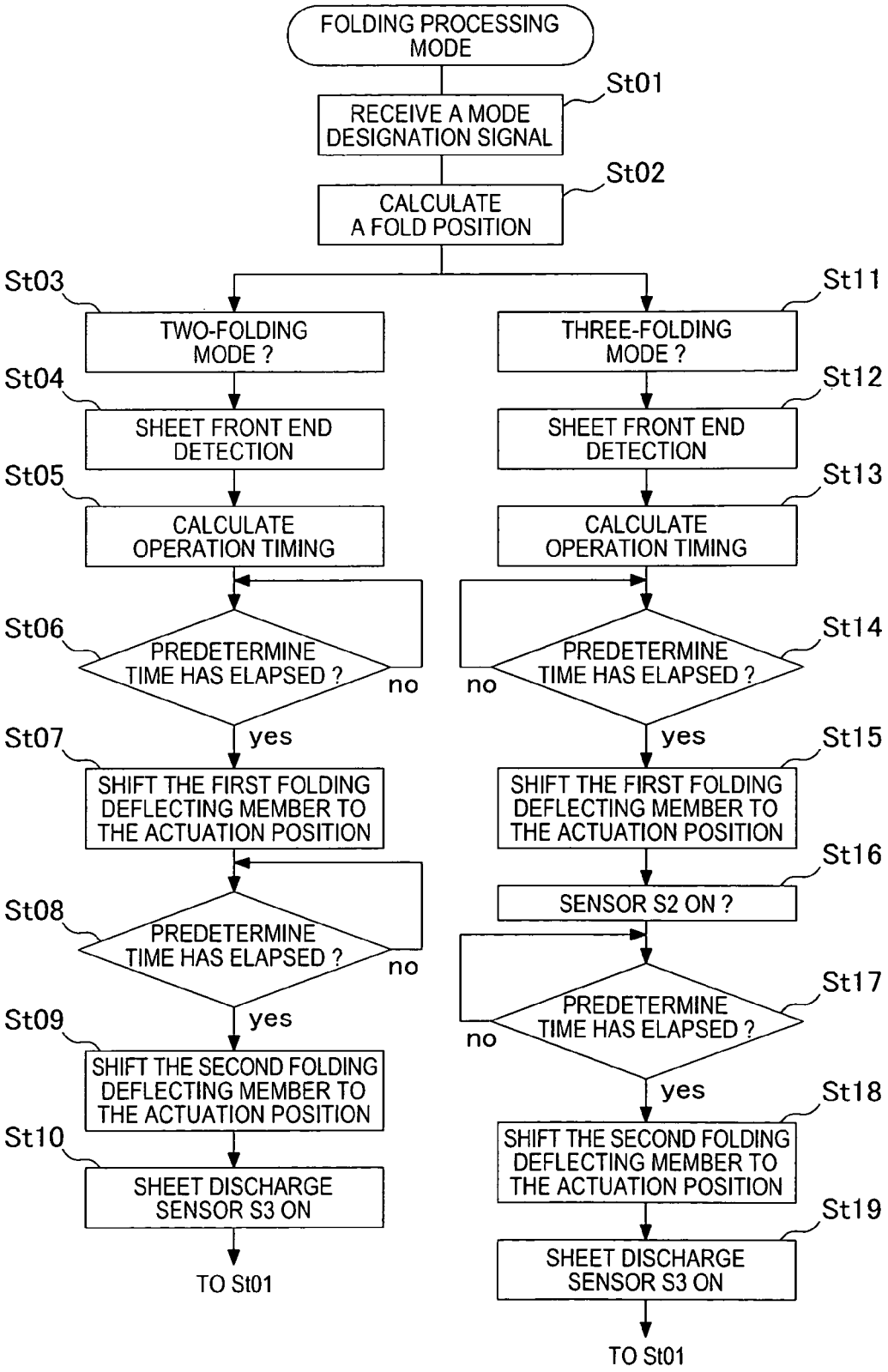
FIG. 16 is a flowchart illustrating processing operation in the control configuration of FIG. 15.

By this means, the control means 95 shifts the first folding deflecting member 53 from the waiting position to the actuation position after a lapse of the delay time (Tx) calculated in the sheet deflecting timing calculating means 99 (see FIG. 16: St06, St07 and St14, St15). In addition, the other operation is the same as the operation as described above, and the description thereof is omitted.

[Embodiment 2 of the Folding Deflecting Member]

As a substitute for the folding deflecting members 53, 54 described based on FIG. 4, it is possible to configure the folding deflecting members to shift using cams as shown in FIG. 17.

As shown in FIG. 17, the sheet deflecting member 53, which guides (inserts) the fold position of the sheet to (in) the nip portion (first folding position) Np1, is provided with the driving means 85 for shifting the member 53 from the waiting position Wp (the solid-line position in FIG. 17) outside the path to the actuation position Ap (the dashed-line position) inside the path.

The above-mentioned folding deflecting member 53 is comprised of the driven roller 53*a* coming into contact with the roller periphery P2 of one of the folding roller pair, 41*b*, 49, and the up-and-down member 53*c* for holding at its one end the driven roller 53*a* to shift from the waiting position Wp to the actuation position Ap.

The up-and-down member 53*c* shown in the figure is supported by the apparatus frame (not shown) to be able to shift between the waiting position and the actuation position. The support structure is not shown in the figure, and is the structure in which a guide rail is provided in the apparatus frame and the up-and-down member is supported on the rail to slide.

The driven roller 53*a* shown in the figure is axially supported by the up-and-down member 53*c* to be slidable, and a pressing spring 53*m* is laid between the up-and-down member 53*c* and the driven roller 53*a* so as to press the driven roller 53*a* toward the roller periphery P2 side.

Figure 17A:
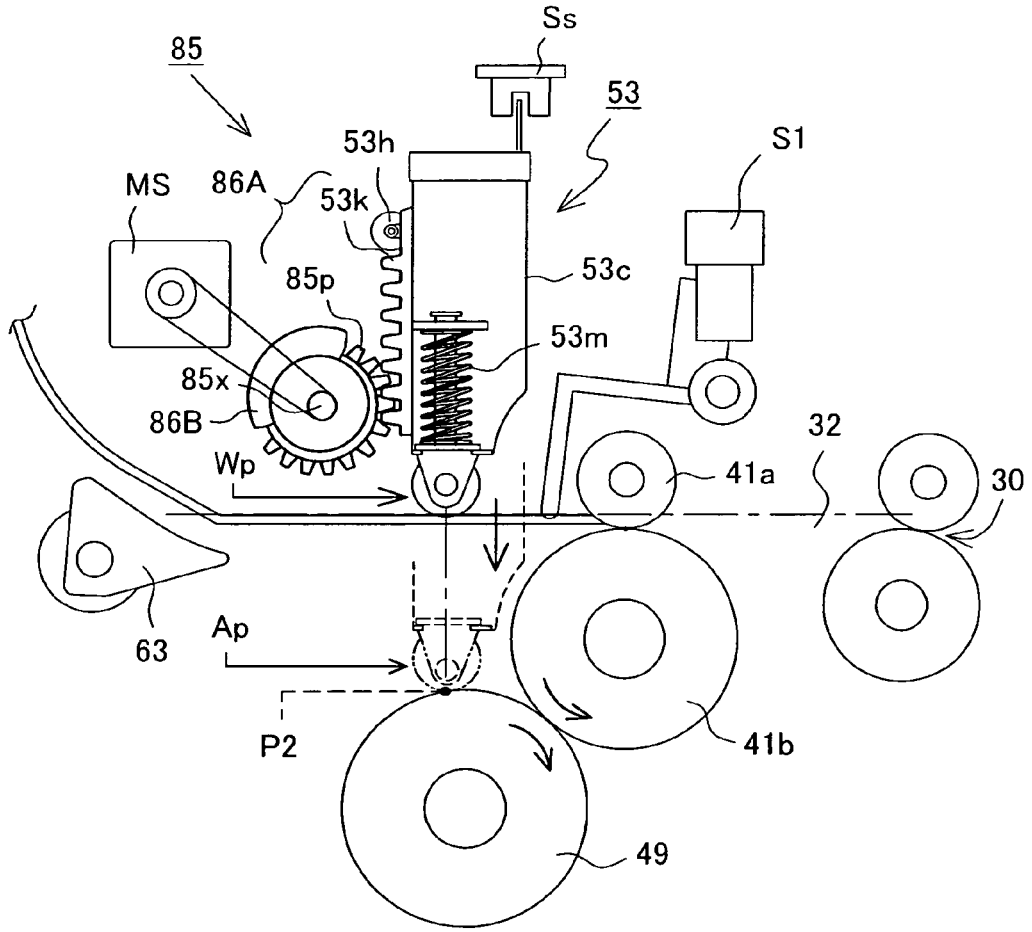
FIG. 17A shows an entire configuration diagram.
Figure 17B:
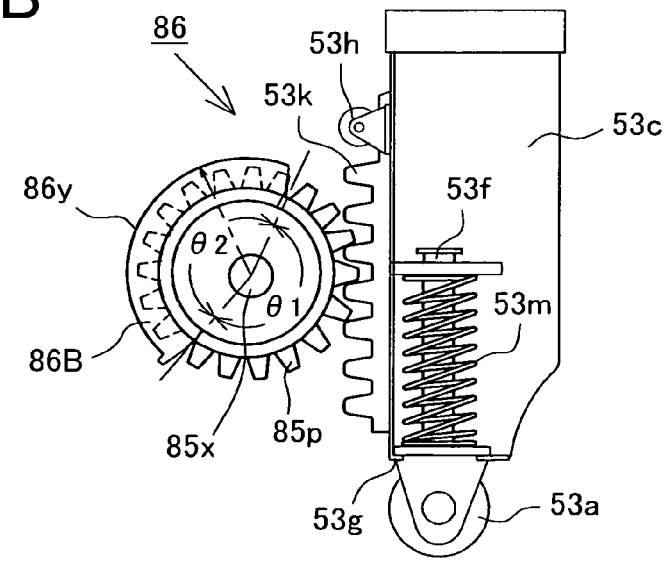
FIG. 17B is an explanatory view of a driving transfer member.

As shown in FIG. 17B, the driven roller 53*a* is attached to the up-and-down member 53*c* to be slidable while being integral with a support stem 53*f*, and the pressing spring 53*m* engages at its one end in the up-and-down member 53*c*, while engaging at the other end in a bracket. "53*g*" shown in the figure denotes a lower limit stopper.

Accordingly, after the up-and-down member 53*c* shifts in the arrow direction in FIG. 17A and the driven roller 53*a* comes into contact with the roller periphery P2, the pressing spring 53*m* applies the force to the roller 53*a*. By the action of the spring, the driven roller 53*a* is biased toward the roller periphery P2 at a predetermined pressure, and provides the sheet with the transport force.

The driving means 85 is comprised of a driving rotary shaft 85*x* coupled to the shift motor MS, and a driving transfer member 86 for motion-transferring the rotation to the up-and-down member 53*c*. In addition, FIG. 17 shows the driving transfer member 86 of Embodiment 2 of the first folding deflecting member 53, FIG. 20 shows the driving transfer member 86 of Embodiment 3 of the first folding deflecting member 53, described later, and further, as the driving transfer member, it is possible to adopt various forms.

The driving transfer member 86 shown in FIG. 17 is comprised of a transmission member 86A for transferring rotation of the driving rotary shaft 85*x* to the up-and-down member 53*c*, and a cam member 86B for holding the position without transferring the rotation of the driving rotary shaft 85*x* to the up-and-down member 53*c*.

The case is shown where the transmission member 86A is comprised of a rack 53*k* integrally formed in the up-and-down member 53*c*, and a pinion 85*p* provided in the driving rotary shaft 85*x*. The pinion 85*p* and rack 53*c* mesh with each other, and the up-and-down member 53*c* shifts from the waiting position Wp to the actuation position Ap by rotation in a clockwise direction of the driving rotary shaft 85*x*, while returning from the actuation position Ap to the waiting position Wp by rotation in a counterclockwise direction of the driving rotary shaft 85*x*. The shift velocity of the up-and-down member 53*c* at this point coincides with the rotation speed of the driving rotary shaft 85*x*.

Further, the cam member 86B is axially supported by the driving rotary shaft 85*x*, and a cam surface 86*y* of the cam member 86B engages in an engagement roller 53*h* (or a protrusion member) of the up-and-down member 53*c*. Then, as described previously, the driving roller 53*a* is attached to the up-and-down member 53*c* via the pressing spring 53*d*. Then, after the predetermined pressing force is acted on the driven roller 53*a*, the cam surface 86*y* of the cam member 86B maintains the state (operating state) even when the driving rotary shaft 85*x* rotates.

In other words, as shown in FIG. 17, the pinion 85*p* and the cam member (cylindrical cam; the same in the following description) 86B are attached to the driving rotary shaft 85*x*, and when the driving rotary shaft 85*x* rotates a predetermined angle range (angle θ1 shown in FIG. 17B), the pinion 85*p* engages in the rack 53*k* to shift the up-and-down member 53*c* in the arrow direction.

Meanwhile, when the driving rotary shaft 85*x* rotates a different angle range (angle θ2 shown in FIG. 17B) from the angle θ1, it is configured that the engagement between the pinion and the rack is released, and that the cam surface 86*y* engages in the engagement roller 53*h* of the up-and-down member 53*c*.

In FIG. 17, the pinion 85*p* in the shape of a semicircle is formed in the angle range θ1 in the outer circumference of the driving rotary shaft 85*x*, and the cam surface 86*y* in the shape of a semicircle is formed in the remaining angle range θ2. Then, the cam surface 86*y* is formed in a circular shape with the same diameter. Accordingly, the angle ranges are set so that the up-and-down member 53*c* travels between the waiting position Wp and the actuation position Ap when the driving rotary shaft 85*x* rotates within the angle range θ1 from the home position, and that the up-and-down member 53*c* is held in the actuation position Ap when the driving rotary shaft 85*x* rotates within the angle range θ2.

In addition, FIG. 17 models the relationship between the pinion 85*p* and the cam surface 86*y*, and there is no inevitability to form the pinion and surface in the shape of a semicircle. By forming the pinion 85*p* and the cam surface 86*y* in the shape of a circle in the outer circumference of the driving rotary shaft 85*x*, and configuring the position relationship that the pinion 85*p* and the rack 53*k* engage in each other in the angle range θ1 of the driving rotary shaft 85*x*, and that the cam surface 86*y* and the engagement roller 53*h* engage in each other in the angle range θ2, it is possible to facilitate the processing.

Figure 18A:
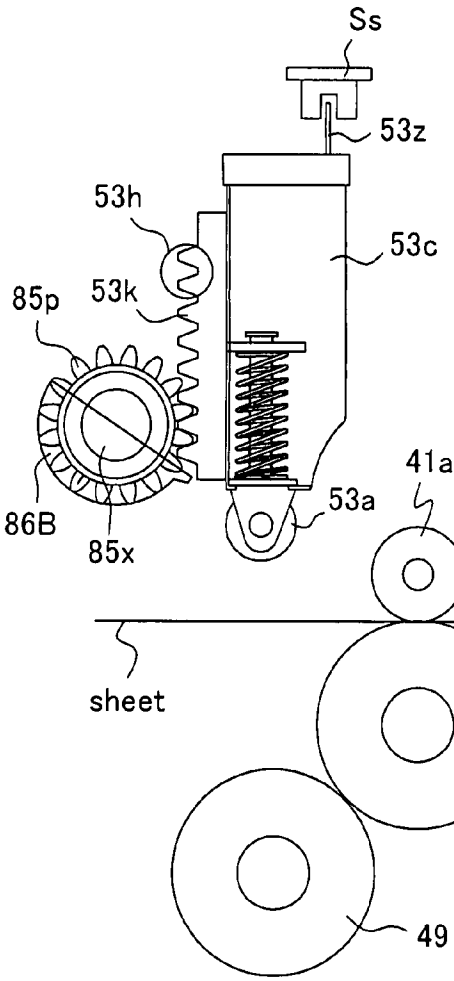
FIG. 18A shows a state of a home position.

The operation of the driving transfer member 86 will be described. FIG. 18A shows a state in which the driving rotary shaft 85*x* is in a home position. At this point, the up-and-down member 53*c* is positioned in the waiting position of the top dead center, and the pinion 85*p* of the driving rotary shaft 85*x* engages in the lower limit position of the rack 53*k*. In addition, a position sensor (position detecting sensor) Ss is disposed in this position to detect a state in which the up-and-down member 53*c* shifts to the upper limit position, and the driving of the shift motor MS is thereby halted. "53*z*" shown in the figure denotes a flag provided in the up-and-down member 53*c*.

Figure 18B:
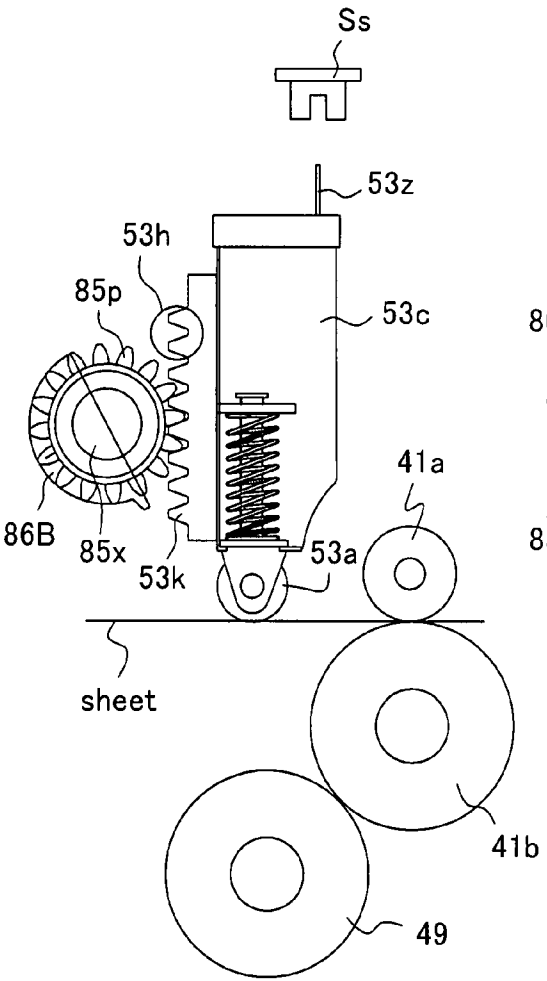
FIG. 18B shows a state in which the member rotates a predetermined angle.

FIG. 18B shows a state in which the shift motor MS is rotated and the driving rotary shaft 85*x* rotates a predetermined angle. At this point, the pinion 85 of the driving rotary shaft 85*x* meshes with the rack 53*k* so as to shift the up-and-down member 53*c* a predetermined amount from the waiting position toward the actuation position. FIG. 18B shows the state in which the driven roller 53*a* first comes into contact with the sheet within the first transport path, and at this point, the shift motor MS is operated to shift the driving rotary shaft 85*x* at a constant speed.

Figure 18C:
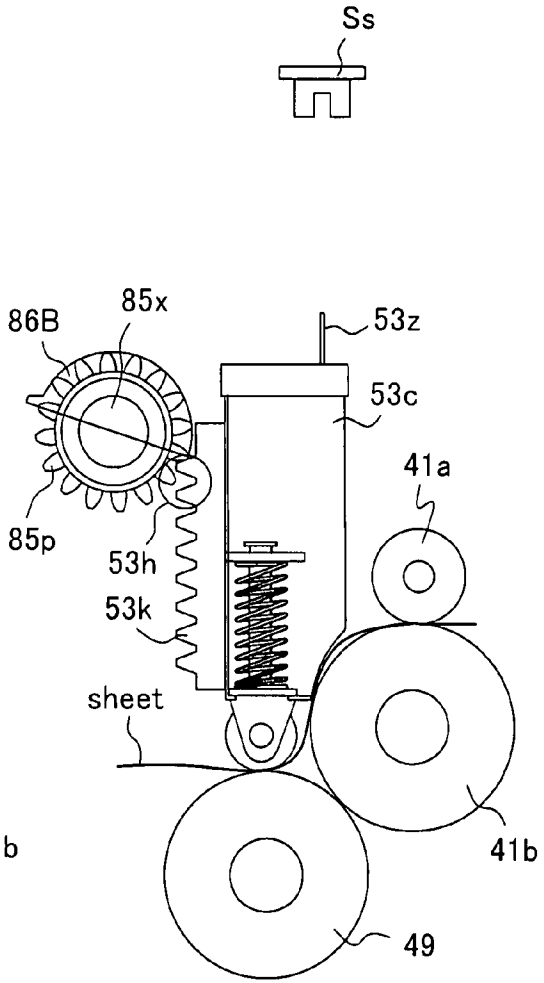
FIG. 18C shows a state in which the member comes into contact with the periphery of the second roller.

FIG. 18C shows a state in which the driven roller 53*a* of the up-and-down member 53*c* comes into contact with the periphery P2 of the second roller 49. At this point, the pinion 85*p* meshes with the rack 53*k*, and the driving force of the driving rotary shaft 85*x* acts on the up-and-down member 53*c* to further shift the up-and-down member 53*c* downward.

Figure 18D:
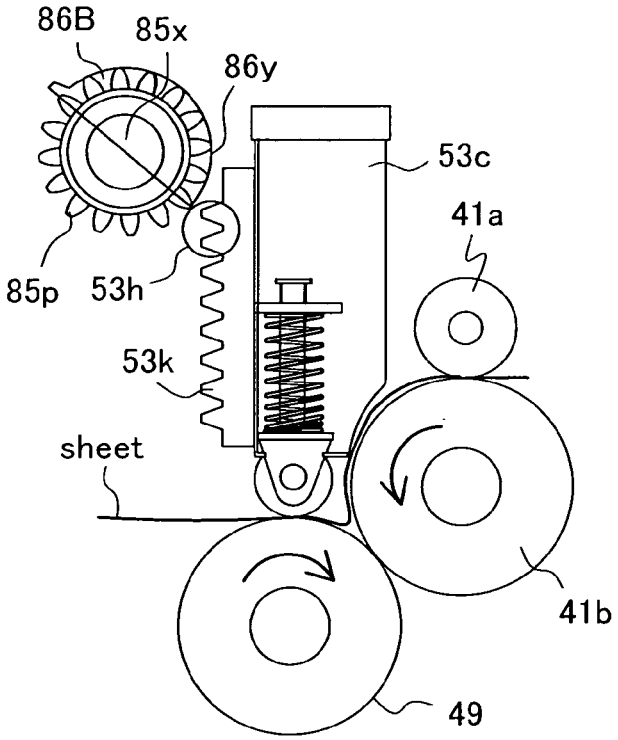
FIG. 18D shows a state in which engagement between the pinion and rack is released.

FIG. 18D shows a state in which the engagement between the pinion 85*p* and the rack 53*k* is released, and the engagement between the cam surface 86*y* and the engagement roller 53*h* is started. When the driving rotary shaft 85*x* rotates in a clockwise direction, the cam surface 86*y* shifts the engagement roller 53*h* downward. At this point, the pressing spring 53*m* applies the force to the driving roller 53*a*, and the driving roller 53*a* is brought into press-contact with the roller periphery P2 at a predetermined pressure. At this point, the driven roller 53*a* is positioned in the actuation position Ap.

Figure 18E:
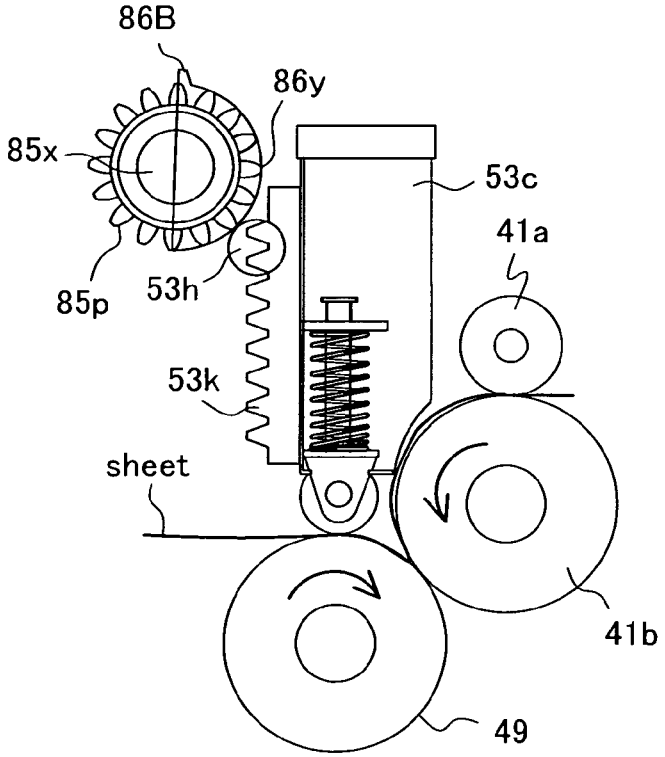
FIG. 18E shows a state in which a shift motor is halted.

In FIG. 18E, after the cam surface 86*y* brings the driven roller 53*a* into press-contact with the roller periphery P2, the shift motor MS is halted. After power supply to the shift motor MS is halted, the driving rotary shaft 85*x* continues rotating by its inertial force. At this point, the cam surface 86*y* continues to bring the driven roller 53*a* into press-contact by a predetermined pressure without shifting the position of the driven roller 53*a* with the sheet sandwiched between the driven roller 53*a* and the roller periphery P2. Then, the shift motor MS is halted gradually by the inertial force.

Then, to return the up-and-down member 53*c* from the actuation position to the waiting position, the control means 95 rotates the shift motor MS backward, and rotates the driving rotary shaft 85*x* in a counterclockwise direction. Then, the cam surface 86*y* also rotates in the counterclockwise direction, and by the action of the pressing spring 53*m*, the pinion 85*p* engages in the rack 53*k*. By the backward rotation of the driving rotary shaft 85*x*, the driven roller 53*a* returns to the waiting position from the state of FIG. 18E in the order of FIG. 18D, FIG. 18C, FIG. 18B and FIG. 18A.

[Control Configuration of the Shift Motor]

Figure 19:
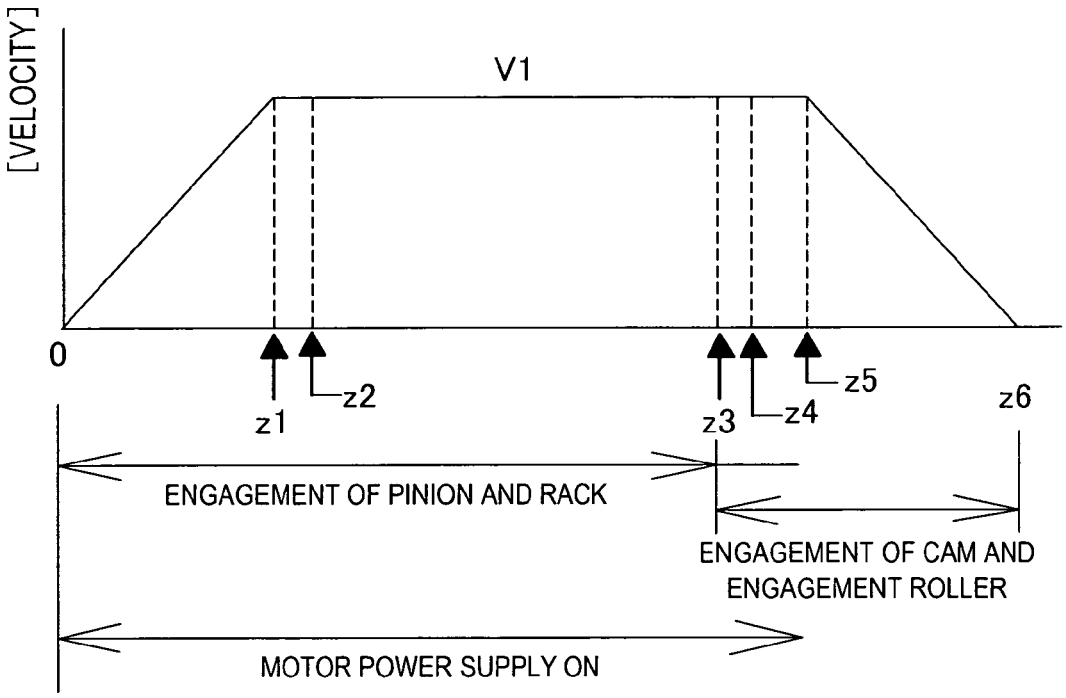
FIG. 19 is a control configuration diagram of the shift motor.

FIG. 19 shows a control configuration of the shift motor MS. The shift motors MS is halted when the up-and-down member 53*c* in the home position (waiting state in FIG. 18A), and holds the position of the up-and-down member 53*c* by its rotation load. Then, after the control means (CPU) 95 detects the sheet front end by the first sensor S1, the shift motor MS is started at predicted time the sheet travels a predetermine amount with reference to the detection signal and the fold position. Then, the up-and-down member 53*c* shifts from the waiting position toward the actuation position. Then, after a lapse of predicted time (z1) the shift motor reaches a predetermined constant speed, the driven roller 53*a* comes into contact with the sheet in the first transport path 32 (z2).

In other words, the control means 95 sets the motor start timing at timing at which the driven roller 53*a* comes into contact with the sheet after the shift motor MS is started and the driven roller 53*a* reaches the constant velocity (V1) set higher than the velocity V2 of the sheet shifting in the first transport path 32 as described previously. In this state, the up-and-down member 53*c* deflects the sheet to the first folding position Np1 at the constant velocity V1. For the motion of the up-and-down member 53*c*, rotation of the driving rotary shaft 85*z* is transferred to the rack 53*k* by the pinion 85*p*.

Then, the rotation of the driving rotary shaft 85*x* releases the engagement between the pinion and the rack when or immediately before the driven roller 53*a* of the up-and-down member 53*c* comes into contact with the folding roller periphery, and the cam surface 86*y* engages in the engagement roller 53*h* (z3). By this means, the cam surface 86*y* presses the up-and-down member 53*c* downward to the folding roller side. At this point, the force is applied from the pressing spring 53*m*, and the driven roller 53*a* engages in the folding roller periphery with a predetermined pressing force (z4).

Next, after the driven roller 53*a* comes into contact with the folding roller periphery P2 and presses the sheet against one of the pair of folding rollers by the predetermined pressing force, the control means 95 shuts off power of the shift motor MS at appropriate timing at which the operation is reliably established (z5). By this means, the rotary shaft of the shift motor MS and the driving rotary shaft 85*x* stop after inertial rotation. At this point, in the up-and-down member 53*c*, the cam surface 86*y* engages in the engagement roller 53*h*, and the circular cam surface 86*y* holds the position (actuation position) of the up-and-down member 53*c* without shifting the position. Accordingly, the inertial rotation of the shift motor MS and the driving rotary shaft 85*x* does not affect the sheet pressing operation of the driven roller 53*a*.

By such control, the up-and-down member 53*c* guides a sheet in the first transport path 32 to the folding roller nip point at the beforehand set constant velocity (design calculation value). Concurrently, the press-contact force between the driven roller 53*a* and the roller periphery P2 is also maintained at the beforehand set pressing force, and further, halt timing of the shift motor MS does not affect the sheet guide operation.

[Embodiment 3 of the Folding Deflecting Member]

Figure 20A:
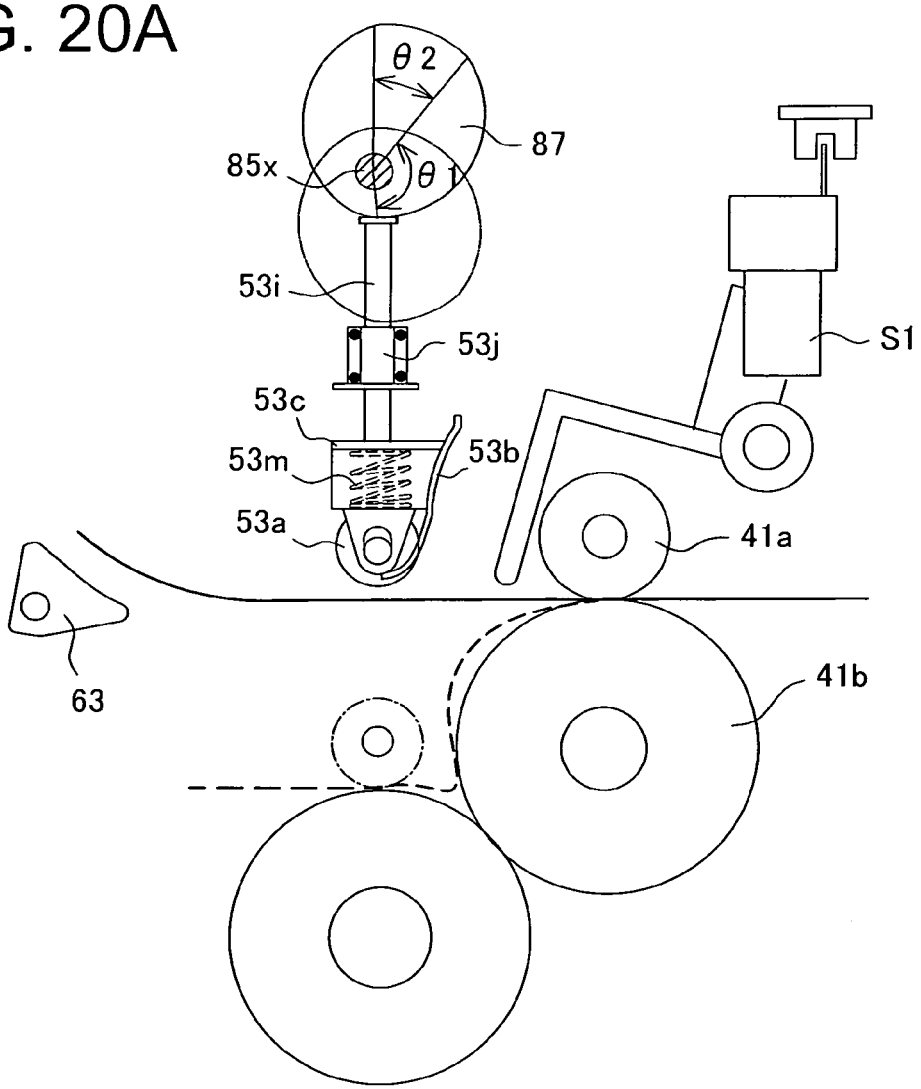
FIG. 20 is an explanatory view of Embodiment 3 of the deflecting member.
Figure 20B:
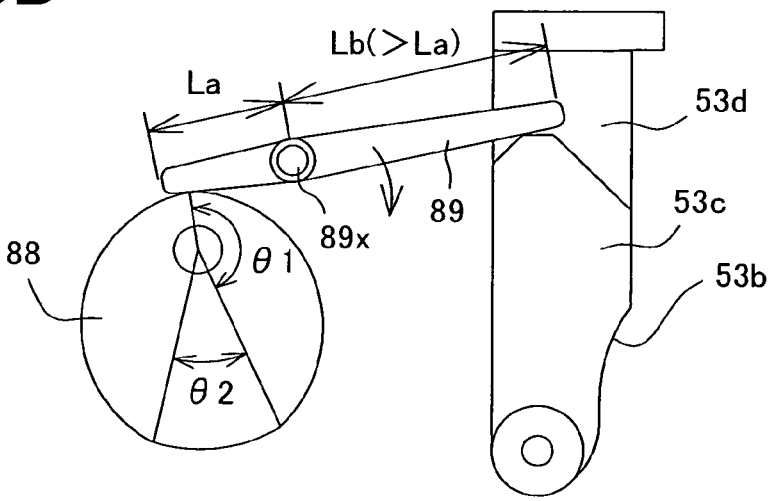

FIGS. 20A and 20B show different Embodiments of the driving transfer member 86. In addition, the same configuration as in FIG. 17 is assigned the same reference numeral to omit the description thereof. The Embodiments shown in the figure illustrate the case where the driving transfer member 86 is comprised of a rotary cam.

First, in the Embodiment as shown in FIG. 20A, a rotary cam 87 is integrally attached to the driving rotary shaft 85*x* coupled to the shift motor MS. In the rotary cam 87 are formed a shift cam surface 87*a* in which a displacement amount increases at a constant rate (linearly) with respect to the displacement angle within the angle range θ1, and a non-shift cam surface 87*b* in which a displacement amount is zero with respect to the displacement angle within the angle range θ2.

Meanwhile, in the up-and-down member 53*c*, as in the member described previously, to the up-and-down member 53*c* are attached the driven roller 53*a*, pressing spring 53*m*, and curved guide 53*b*. The up-and-down member 53*c* is integrally provided with the support stem 53*i*, and the stem is fitted and supported by a sleeve 53*j* fixed to the apparatus frame to be slidable. Further, for the pressing spring 53*m*, not shown in the figure, as in the spring as described previously, the driven roller 53*a* is engaged in the up-and-down member 53*c* to be slidably, and the pressing spring 53*m* is disposed between the up-and-down member 53*c* and the driven roller 53*a*.

The rotary cam 87 engages in thus configured up-and-down member 53*c*. Then, when the driving rotary shaft 85*x* rotates within the angle range θ1, the shift cam surface 87*a* engages in the up-and-down member 53*c* and shifts downward at the predetermined velocity (V1). Meanwhile, when the driving rotary shaft 85*x* rotates within the angle range θ2, the non-shift cam surface 87*b* engages in the up-and-down member 53*c* and holds the position.

Next, in the Embodiment as shown in FIG. 20B, a rotary cam 88 and the up-and-down member 53*c* are engaged by a transmission lever 89. This is because the rotary cam is upsized due to the relation of the shift stroke of the up-and-down member 53*c* in the Embodiment as shown in FIG. 20A. Then, the shift amount of the up-and-down member 53*c* is increased by the transmission lever 89. Therefore, in the transmission lever 89, the engagement point La with the cam surface is set at a short distance, while the engagement point Lb with the up-and-down member 53*c* is set at a long distance, so that the action of the lever acts on the rotary spindle 89*x*.

Also in the Embodiments as shown in FIGS. 20A and 20B, control of the shift motor MS is the same control as in Embodiment 2 described in FIG. 19, and the same operation is obtained.

In addition, in the apparatus as shown in FIG. 2, as the folding deflecting member for guiding a sheet to the nip portion of the folding roller pair, disposed are the first folding deflecting member 53 for first folding the sheet, and the second folding deflecting member 54 for further folding the first-folded sheet as second folding. The second folding deflecting member 54 adopts the same structure as the first folding deflecting member 53 as described above.

In addition, this application claims priority from Japanese Patent Application No. 2010-149507, Japanese Patent Application No. 2010-171286, and Japanese Patent Application No. 2010-225596 incorporated herein by reference.

What is claimed is:

1. A sheet folding apparatus for performing folding processing on a sheet from a carry-in portion to carry out to a carrying-out portion, comprising:

a first transport path for guiding a sheet from the carry-in portion to the carrying-out portion without performing the folding processing;

a second transport path disposed in a direction to cross the first transport path to perform the folding processing on a sheet;

a folding roller pair disposed in the second transport path to perform the folding processing on the sheet; and a folding deflecting member that inserts a fold position of the sheet in a nip portion of the folding roller pair, wherein the second transport path is comprised of an upstream-side guide path branching off from a cross portion with the first transport path to guide a front end portion of the sheet, and a downstream-side guide path for guiding the sheet to the downstream side from the cross portion, the folding roller pair is disposed in the cross portion of the first transport path and the second transport path, the folding deflecting member is comprised of a driven roller that comes into press-contact with a roller periphery of the folding roller pair positioned on the downstream side in a traveling direction of the sheet shifting in the first transport path, and a shift member that shifts positions of the driven roller between a waiting position withdrawn from the first transport path and an actuation position for guiding the sheet to the nip portion, and the shift member is set so that a velocity at which the driven roller is shifted from the waiting position to the actuation position is higher than a velocity of the sheet shifting in the first transport path.

2. The sheet folding apparatus according to claim 1, wherein a paper feed transport member for feeding the sheet toward the cross portion is disposed in the first transport path, and the shift member shifts the driven roller from the waiting position to the actuation position at a velocity higher than a sheet transport velocity by the paper feed transport member, while carrying the front end of the sheet to inside the upstream-side guide path by transport force applied from the paper feed transport member, and carrying the sheet toward the nip portion of the folding roller pair by shifting the driven roller from the waiting position to the actuation position.

3. The sheet folding apparatus according to claim 2, wherein the upstream-side guide path of the second transport path is configured to provide the sheet with a transport load, the paper feed transport member carries the front end portion of the sheet in the upstream-side guide path, and the front end of the sheet is carried out of the upstream-side guide path by the driven roller that comes into press-contact with the roller periphery of the folding roller pair to be driven.

4. The sheet folding apparatus according to claim 3, wherein the downstream-side guide path of the second transport path is configured in a curved path that is curved in the shape of an arc, and the sheet from the carry-in portion is shifted to the carrying-out portion using a transport path substantially in the shape of an S of from the upstream-side guide path to the downstream-side guide path.

5. The sheet folding apparatus according to claim 2, wherein the paper feed transport member is comprised of a pair of rollers coming into press-contact with each other, a circumferential velocity of the pair of rollers is substantially set at the same velocity as a circumferential velocity of the folding roller pair, and a sheet press-contact force of the paper feed transport member is set at a force larger than a sheet press-contact force between the driven roller and the folding roller periphery.

6. The sheet folding apparatus according to claim 5, wherein at least part of the periphery of the folding roller pair is disposed in a position facing the first transport path, and the paper feed transport member is comprised of the part of the periphery of the folding roller pair and a pinch roller in press-contact with the periphery.

7. The sheet folding apparatus according to claim 5, wherein when P1 is a press-contact point of the pair of rollers constituting the paper feed transport member, P2 is a contact point in which the driven roller comes into contact with the roller periphery of the folding roller pair, and P3 is a contact point in which the driven roller first comes into contact with the sheet shifting in the first transport path, a sheet transport length between P1 and P2 is set at a longer length than a sheet transport length between P1 and P3.

8. The sheet folding apparatus according to claim 7, wherein when Vh is a velocity at which the driven roller shifts from the waiting position to the actuation position, Vs is a velocity at which the paper feed transport member transports the sheet, Dy is the sheet transport length between P1 and P2, Dx is the sheet transport length between P1 and P3, and Dz is a shift distance between the position in which the driven roller first comes into contact with the sheet shifting in the first transport path and a point in which the driven roller comes into contact with the folding roller periphery, the relationship of $(Dy-Dx)/Vs \approx Dx/Vh$ holds.

9. The sheet folding apparatus according to claim 1, wherein the folding deflecting member is provided with a curved guide for bringing the sheet along a folding roller periphery positioned on the upstream side in the traveling direction of the sheet shifting in the first transport path, together with the driven roller.

10. A sheet folding apparatus for performing folding processing on a sheet fed to a transport path, comprising:

a folding roller pair disposed in the transport path;

a carry-in member disposed on the upstream side of the folding roller pair to carry the sheet in the transport path;

a sheet front end detecting member disposed on the upstream side of the folding roller pair to detect a front end of the sheet that is carried in by the carry-in member;

a folding deflecting member that guides a fold of the sheet to a nip portion of the folding roller pair;

a shift member that reciprocates the folding deflecting member between a waiting position withdrawn from the transport path and an actuation position for guiding the sheet to a folding processing section; and control means for controlling the shift member based on a detection signal from the sheet front end detecting member, wherein the folding deflecting member is comprised of an up-and-down member that reciprocates between the waiting position outside the transport path and the actuation position inside the transport path, and a driven roller that is supported by the up-and-down member and engages in the sheet, the control means has calculating means for calculating a sheet deflecting velocity at which the folding deflecting member shifts from the waiting position to the actuation position, and shift start timing of the folding deflecting member, based on a detection signal from the sheet front end detecting member, and a sheet transport velocity at which the carry-in member carries the sheet toward the nip portion, and the calculating means sets the sheet deflecting velocity at a higher velocity than the sheet transport velocity in a certain magnification relationship.

11. The sheet folding apparatus according to claim 10, wherein the calculating means calculates the shift start timing of the folding deflecting member with reference to a detection signal of the sheet front end detecting member, based on the sheet deflecting velocity set in the certain magnification relationship from the sheet transport velocity.

12. A sheet folding apparatus for performing folding processing on a sheet fed to a transport path, comprising:

a folding roller pair disposed in the transport path to come into press-contact with each other;

a folding deflecting member that inserts a fold position of the sheet fed to the transport path in a nip portion of the folding roller pair; and driving means for reciprocating the folding deflecting member between a waiting position withdrawn from the transport path and an actuation position for coming into contact with a roller periphery of the folding roller pair, wherein the folding deflecting member is comprised of a driven roller that comes into press-contact with the roller periphery of one of the folding roller pair, and an up-and-down member that holds at its one end the driven roller to shift from the waiting position to the actuation position, a velocity at which the up-and-down member shifts from the waiting position to the actuation position is set to be higher than a velocity of the sheet shifting in the transport path, the driving means is comprised of a driving rotary shaft coupled to a driving motor, and a driving transfer member that transfers, as motion, rotation of the driving rotary shaft to the up-and-down member, and the driving transfer member transfers, as driving, rotation of the driving rotary shaft to the up-and-down member so that the up-and-down member shifts from the waiting position to the actuation position at a predetermined velocity, while not transferring the driving to permit rotation of the driving rotary shaft after the driven roller comes into contact with the periphery of the folding roller pair.

13. The sheet folding apparatus according to claim 12, wherein the driving transfer member performs driving transfer operation and non-driving transfer operation on rotation of the driving rotary shift, the driving transfer operation for shifting the up-and-down member from the waiting position to the actuation position, the non-driving transfer operation for holding the position of the up-and-down member in the actuation position with the driven roller brought into contact with the periphery of the folding roller pair.

14. The sheet folding apparatus according to claim 12, wherein the driving transfer member is comprised of a transmission member for shifting the up-and-down member from the waiting position to the actuation position by rotation of the driving rotary shaft, and a cam member for holding the position of the up-and-down member in the actuation position by rotation of the driving rotary shaft.

15. The sheet folding apparatus according to claim 14, wherein the transmission member is comprised of a pinion coupled to the driving rotary shaft and a rack disposed in the up-and-down member, and the cam member is comprised of a rotary cam coupled to the driving rotary shaft and an engagement roller disposed in the up-and-down member.

16. The sheet folding apparatus according to claim 12, wherein the driving transfer member is comprised of a cam member for shifting the up-and-down member from the waiting position to the actuation position, and the cam member has a shift cam surface for shifting the up-and-down member from the waiting position to the actuation position by rotation of the driving rotary shaft, and a non-shift cam surface for holding the position of the up-and-down member in the actuation position by rotation of the driving rotary shaft.

17. The sheet folding apparatus according to claim 12, wherein the folding deflecting member is provided with a pressing spring for pressing the driven roller against the roller periphery of the folding roller pair for press-contact.

18. The sheet folding apparatus according to claim 12, wherein the driving rotary shaft is coupled to a driving motor, and the driving motor is controlled to halt driving with reference to a position detection signal from a position detecting sensor disposed in the up-and-down member.

19. The sheet folding apparatus according to claim 12, wherein the up-and-down member is provided with a curved guide together with the driven roller, the driven roller is disposed on one roller side of the folding roller pair, and the curved guide is disposed on the other roller side to be opposed to the driven roller.

* * * * *